US010415357B2

(12) United States Patent
Johns et al.

(10) Patent No.: US 10,415,357 B2
(45) Date of Patent: Sep. 17, 2019

(54) FRAC FLOW-BACK CONTROL AND/OR MONITORING SYSTEM AND METHODS

(71) Applicant: Seaboard International Inc., Houston, TX (US)

(72) Inventors: Roger Johns, Tuttle, OK (US); Stephen Folmar, The Village, OK (US); Matthew B. Green, Norman, OK (US); Levent Aktas, Norman, OK (US); Timothy Long, Oklahoma City, OK (US); Ron Hersche, Magnolia, TX (US)

(73) Assignee: Seaboard International Inc., Houston, TX (US)

( * ) Notice: Subject to any disclaimer, the term of this patent is extended or adjusted under 35 U.S.C. 154(b) by 222 days.

(21) Appl. No.: 15/391,294

(22) Filed: Dec. 27, 2016

(65) Prior Publication Data

US 2017/0191350 A1 Jul. 6, 2017

Related U.S. Application Data

(60) Provisional application No. 62/273,568, filed on Dec. 31, 2015, provisional application No. 62/347,872, filed on Jun. 9, 2016.

(51) Int. Cl.
*E21B 43/26* (2006.01)
*E21B 21/08* (2006.01)

(52) U.S. Cl.
CPC ..... *E21B 43/26* (2013.01); *E21B 21/08* (2013.01)

(58) Field of Classification Search
CPC ..... E21B 43/26; E21B 44/06; E21B 44/00; E21B 34/08; E21B 47/06; E21B 21/08
See application file for complete search history.

(56) References Cited

U.S. PATENT DOCUMENTS 6,048,175 A 4/2000 Corlew et al.
8,794,061 B1 8/2014 Sickels, Jr.
(Continued)

FOREIGN PATENT DOCUMENTS

WO WO 2016/094474 A1 6/2016

OTHER PUBLICATIONS

International Search Report and Written Opinion issued by the US International Searching Authority regarding International Application No. PCT/US15/64618 dated Apr. 1, 2016, 18 pages.
(Continued)

*Primary Examiner* — Michael R Wills, III
(74) *Attorney, Agent, or Firm* — Wei Wei Jeang; Grable Martin Fulton PLLC

(57) ABSTRACT

According to one aspect, a system is adapted to actively control one or more operating parameters associated with: a wellbore extending in a subterranean formation, and/or wellbore fluid flowing out of the wellbore via a wellhead. The system includes one or more sensors; an electronic controller adapted to receive from the one or more sensors measurement data; and a valve through which the wellbore fluid is adapted to flow. The valve is adapted to be in communication with the electronic controller. The active control of the at least one of the one or more operating parameters is adapted to facilitate: maintenance of the integrity of the wellbore, and/or enhancement of oil and/or gas production out of the wellbore. In one embodiment, the wellbore fluid flow is frac flow-back. In another aspect, a system is adapted to monitor vent gas separated from wellbore fluid flowing out a wellhead.

23 Claims, 11 Drawing Sheets

(56) References Cited

U.S. PATENT DOCUMENTS

| | | | | |
|---|---|---|---|---|
| 2003/0037613 | A1 | 2/2003 | Mulrooney et al. | |
| 2007/0246263 | A1* | 10/2007 | Reitsma | E21B 21/06 175/38 |
| 2009/0189110 | A1 | 7/2009 | Dolenti et al. | |
| 2011/0005312 | A1 | 1/2011 | Hopper | |
| 2011/0114389 | A1 | 5/2011 | Mathena | |
| 2012/0241217 | A1* | 9/2012 | Davis | E21B 44/00 175/26 |
| 2013/0032217 | A1 | 2/2013 | Pesek et al. | |
| 2013/0112404 | A1* | 5/2013 | Lovorn | E21B 21/08 166/250.01 |
| 2013/0146357 | A1* | 6/2013 | Lovorn | E21B 21/08 175/24 |
| 2014/0208840 | A1 | 7/2014 | Bright | |
| 2014/0262516 | A1 | 9/2014 | Larson | |
| 2015/0240579 | A1* | 8/2015 | Lovorn | E21B 21/08 166/373 |
| 2016/0168933 | A1 | 6/2016 | Aktas et al. | |

OTHER PUBLICATIONS

International Search Report and Written Opinion issued by the US International Searching Authority regarding International Application No. PCT/US15/64625 dated Feb. 12, 2016, 15 pages.

International Preliminary Report on Patentability issued by the US International Searching Authority regarding International Application No. PCT/US15/64618 dated Jun. 13, 2017, 9 pages.

International Preliminary Report on Patentability issued by the US International Searching Authority regarding International Application No. PCT/US15/64625 dated Jun. 13, 2017, 7 pages.

* cited by examiner

FRAC FLOW-BACK CONTROL AND/OR MONITORING SYSTEM AND METHODS

CROSS-REFERENCE TO RELATED APPLICATIONS

This patent application claims priority to, and the benefit of the filing date of, U.S. Application No. 62/273,568, filed Dec. 31, 2015, the entire disclosure of which is hereby incorporated herein by reference.

This patent application claims priority to, and the benefit of the filing date of, U.S. Application No. 62/347,872, filed Jun. 9, 2016, the entire disclosure of which is hereby incorporated herein by reference.

This patent application is related to the following patent applications: (1) U.S. Application No. 62/089,913, filed Dec. 10, 2014; (2) U.S. Application No. 62/173,633, filed Jun. 10, 2015; (3) U.S. Application No. 62/180,735, filed Jun. 17, 2015; (4) U.S. application Ser. No. 14/963,839, filed Dec. 9, 2015; (5) International Application No. PCT/US2015/064625, filed Dec. 9, 2015, (6) International Application No. PCT/US2015/064618, filed Dec. 9, 2015; (7) U.S. Application No. 62/273,568, filed Dec. 31, 2015; (8) U.S. Application No. 62/316,724, filed Apr. 1, 2016; (9) U.S. application Ser. No. 15/176,859, filed Jun. 8, 2016; (10) International Application No. PCT/US2016/036415, filed Jun. 8, 2016; and (11) U.S. Application No. 62/347,872, filed Jun. 9, 2016, the entire disclosures of which are hereby incorporated herein by reference.

TECHNICAL FIELD

This disclosure relates in general to fluid flow control systems and methods and, in particular, to a system for monitoring and/or actively controlling wellbore fluid flowing out of an oil and gas wellhead.

BACKGROUND OF THE DISCLOSURE

Several operations may be employed to facilitate oil and gas exploration and production operations. One example is a hydraulic fracturing operation, during which hydraulic fracturing fluid, or slurry, is pumped to a wellhead for the purpose of propagating fractures in a subterranean formation in which a wellbore extends, the wellhead being the surface termination of the wellbore. The hydraulic fracturing fluid or slurry is used to fracture the subterranean formation. During and after the hydraulic fracturing operation, the fluid used in the operation flows back up to, and out of, the wellhead. This wellbore fluid flow may be referred to as "frac flow-back," and the fluid itself may be referred to as "flow-back." The flow-back may include the hydraulic fracturing fluid or slurry pumped to the wellhead, as well as fluids and other materials from the fractured formation. Another example of an operation employed to facilitate oil and gas exploration and production operation is a well testing operation, during which fluid is pumped to the wellhead and into the wellbore to test the formation; this fluid also flows back up to, and out of, the wellhead. During operations involving wellbore fluid flow out of the wellhead, such as hydraulic fracturing or well testing operations, the wellbore fluid flow out of the wellbore must be controlled to maintain the integrity of the wellbore and, in many cases, maximize production from the wellbore. For example, if the wellbore fluid flow is too fast (i.e., the wellbore fluid volumetric flow rate or velocity is too high), the wellbore may collapse, decreasing production. Conversely, if the wellbore fluid flow is too slow (i.e., the wellbore fluid volumetric flow rate or velocity is too low), the wellbore may clog, also decreasing production. Further, during operations involving wellbore fluid flow out of the wellhead, such as hydraulic fracturing or well testing operations, the wellbore fluid flow out of the wellbore must be monitored and/or controlled to prevent, or at least minimize the risk of, erosion, washout or rupture of valves, flow lines, flow iron, etc. through which the wellbore fluid flows. Still further, during operations involving wellbore fluid flow out of the wellhead, such as hydraulic fracturing or well testing operations, the wellbore fluid flow out of the wellbore must be monitored and/or controlled to monitor the composition of vent gas (i.e., the percentage of the vent gas that is production gas (e.g., methane), the percentage of the vent gas that is gas used in a hydraulic fracturing operation (e.g., carbon dioxide), other percentage(s) of the vent gas, etc.). Therefore, what is needed is a system, method, kit, apparatus, or assembly that addresses one or more of these issues, and/or other issue(s).

SUMMARY

In a first aspect, there is provided a method of actively controlling a volumetric flow rate of a wellbore fluid flowing out of a wellhead, the method including measuring, using a first sensor, a fluid level within a first fluid reservoir into which at least a portion of the wellbore fluid is adapted to flow; transmitting measurement data from the first sensor to an electronic controller, the measurement data being associated with the measurement of the fluid level within the first fluid reservoir; and controlling, using the electronic controller, a valve based on at least the measurement data associated with the measurement of the fluid level within the first fluid reservoir; wherein the control of the valve by the electronic controller automatically controls the volumetric flow rate of the wellbore fluid and thus actively controls the volumetric flow rate based on at least the measurement of the fluid level within the first fluid reservoir.

In an exemplary embodiment, the valve has an open/closed position that controls the volumetric flow rate of the wellbore fluid; wherein an electric actuator is operably coupled to the valve; and wherein controlling the valve based on at least the measurement data associated with the measurement of the fluid level within the first fluid reservoir, to automatically control the volumetric flow rate of the wellbore fluid and thus actively control the volumetric flow rate, includes: reading, using the electronic controller, the measurement data received from the first sensor; transmitting a control output from the electronic controller to the electric actuator, the control output being based on at least the measurement data received from the first sensor and read by the electronic controller; and adjusting, using the electric actuator, the open/closed position of the valve based on the control output.

In another exemplary embodiment, the valve is a choke valve to which the electric actuator is operably coupled; and wherein the choke valve and the electric actuator operably coupled thereto are mounted on, and/or are part of, a choke manifold skid.

In yet another exemplary embodiment, the control output includes one or more electrical control signals.

In certain exemplary embodiments, the electronic controller controls the valve using at least one of the following: a continuous proportional-integral-derivative (PID) algorithm having a first measured process variable; and a discrete PID algorithm having a second measured process variable; wherein each of the first and second measured process variables is either: a rate of change of the fluid level within the first fluid reservoir; or a pressure of a wellbore of which the wellhead is the surface termination.

In an exemplary embodiment, the first sensor is a guided wave level sensor that measures the fluid level within the first fluid reservoir.

In another exemplary embodiment, the wellbore fluid flows through one or more three-phase separators after flowing through the valve and before flowing into the first fluid reservoir.

In yet another exemplary embodiment, the wellbore fluid flow out of the wellhead is frac flow-back.

In still yet another exemplary embodiment, the method includes measuring, using a second sensor, a fluid level within a second fluid reservoir into which at least another portion of the wellbore fluid is adapted to flow; and transmitting measurement data from the second sensor to the electronic controller, the measurement data being associated with the measurement of the fluid level within the second fluid reservoir; wherein controlling, using the electronic controller, the valve based on at least the measurement data associated with the measurement of the fluid level within the first fluid reservoir includes: controlling, using the electronic controller, the valve based on at least: the measurement data associated with the measurement of the fluid level within the first fluid reservoir, and the measurement data associated with the measurement of the fluid level within the second fluid reservoir; and wherein the control of the valve by the electronic controller automatically controls the volumetric flow rate of the wellbore fluid and thus actively controls the volumetric flow rate based on at least: the measurement of the fluid level within the first fluid reservoir, and the measurement of the fluid level within the second fluid reservoir.

In certain exemplary embodiments, the valve has an open/closed position that controls the volumetric flow rate of the wellbore fluid; wherein an electric actuator is operably coupled to the valve; and wherein controlling the valve based on at least the measurement data associated with the measurement of the fluid level within the first fluid reservoir, to automatically control the volumetric flow rate of the wellbore fluid and thus actively control the volumetric flow rate, includes: reading, using the electronic controller, the measurement data received from the first sensor; reading, using the electronic controller, the measurement data received from the second sensor; transmitting a control output from the electronic controller to the electric actuator, the control output being based on at least: the measurement data received from the first sensor and read by the electronic controller, and the measurement data received from the second sensor and read by the electronic controller; and adjusting, using the electric actuator, the open/closed position of the valve based on the control output.

In a second aspect, there is provided a system adapted to actively control a volumetric flow rate of a wellbore fluid flowing out of a wellhead, the system including a first sensor adapted to measure a fluid level within a first fluid reservoir into which at least a portion of the wellbore fluid is adapted to flow; an electronic controller adapted to receive from the first sensor measurement data associated with the measurement of the fluid level within the first fluid reservoir; and a valve through which the wellbore fluid is adapted to flow; wherein the electronic controller is adapted to automatically control the valve based on at least the measurement data associated with the measurement of the fluid level within the first fluid reservoir, and thus the electronic controller is adapted to actively control the volumetric flow rate based on at least the measurement of the fluid level within the first fluid reservoir.

In an exemplary embodiment, the valve has an open/closed position adapted to control the volumetric flow rate of the wellbore fluid; wherein the system further includes an electric actuator adapted to be operably coupled to the valve, and adapted to be in communication with the electronic controller; wherein the electronic controller is adapted to transmit a control output to the electric actuator, the control output being based on at least the measurement data received from the first sensor and associated with the measurement of the fluid level within the first fluid reservoir; wherein the electric actuator is adapted to adjust the open/closed position of the valve based on the control output.

In another exemplary embodiment, the valve is a choke valve to which the electric actuator is adapted to be operably coupled; and wherein the choke valve and the electric actuator are adapted to be mounted on, and/or to be part of, a choke manifold skid.

In yet another exemplary embodiment, the control output includes one or more electrical control signals.

In still yet another exemplary embodiment, the electronic controller is adapted to control the valve using at least one of the following: a continuous proportional-integral-derivative (PID) algorithm having a first measured process variable; and a discrete PID algorithm having a second measured process variable; wherein each of the first and second measured process variables is either: a rate of change of the fluid level within the first fluid reservoir; or a pressure of a wellbore of which the wellhead is the surface termination.

In certain exemplary embodiments, the first sensor is a guided wave level sensor that is adapted to measure the fluid level within the first fluid reservoir.

In an exemplary embodiment, the wellbore fluid flow out of the wellhead is frac flow-back.

In another exemplary embodiment, the system includes a second sensor adapted to measure a fluid level within a second fluid reservoir into which at least another portion of the wellbore fluid is adapted to flow; wherein the electronic controller is adapted to receive from the second sensor measurement data associated with the measurement of the fluid level within the second fluid reservoir; and wherein the electronic controller is adapted to automatically control the valve based on at least: the measurement data associated with the measurement of the fluid level within the first fluid reservoir, and the measurement data associated with the measurement of the fluid level within the second fluid reservoir.

In yet another exemplary embodiment, the valve has an open/closed position adapted to control the volumetric flow rate of the wellbore fluid; wherein the system further includes an electric actuator adapted to be operably coupled to the valve, and adapted to be in communication with the electronic controller; wherein the electronic controller is adapted to transmit a control output to the electric actuator, the control output being based on at least: the measurement data received from the first sensor and associated with the measurement of the fluid level within the first fluid reservoir, and the measurement data received from the second sensor and associated with the measurement of the fluid level within the second fluid reservoir; and wherein the electric actuator is adapted to adjust the open/closed position of the valve based on the control output.

In a third aspect, there is provided a system adapted to be in fluid communication with a wellhead, the system including a choke manifold skid; a choke valve associated with the choke manifold skid and adapted to be in fluid communication with the wellhead, wherein wellbore fluid is adapted to flow from the wellhead and through the valve, and wherein the choke valve has an open/closed position to control a volumetric flow rate of the wellbore fluid through the valve; an electric actuator operably coupled to the choke valve and adapted to adjust the open/closed position of the choke valve to control the volumetric flow rate of the wellbore fluid through the valve; an electronic controller adapted to be in communication with the electric actuator and adapted to transmit a control output to the electric actuator, wherein the electric actuator is adapted to adjust the open/closed position of the choke valve based on the control output; and a first sensor adapted to measure a fluid level within a first fluid reservoir; wherein the electronic controller is adapted to receive from the first sensor measurement data associated with the measurement of the fluid level with the first fluid reservoir; and wherein the control output is based on at least the measurement data associated with the measurement of the fluid level within the first fluid reservoir so that the adjustment of the open/closed position of the valve by the electric actuator is adapted to actively control the volumetric flow rate based on at least the measurement of the fluid level within the first fluid reservoir.

In a fourth aspect, there is provided a method of actively controlling a plurality of operating parameters associated with wellbore fluid flowing in a system, the system including a wellhead out of which the wellbore fluid flows, the plurality of operating parameters including a velocity of the wellbore fluid, and a pressure of a wellbore of which the wellhead is the surface termination, the method including: measuring, using a plurality of sensors, physical properties within the system; transmitting measurement data from the plurality of sensors to an electronic controller, the measurement data being associated with the respective measurements of the physical properties; controlling, using the electronic controller, a first valve based on at least a first portion of the measurement data, wherein the control of the first valve actively controls the pressure of the wellbore; and controlling, using the electronic controller, a second valve based on at least: the first portion of the measurement data, and/or a second portion of the measurement data, wherein the control of the second valve actively controls the velocity of the wellbore fluid.

In an exemplary embodiment, the first valve is a first electric-actuated choke, which is in communication with the electronic controller and has an open/closed position; wherein the method further includes reading, using the electronic controller, the measurement data received from the plurality of sensors; and wherein controlling, using the electronic controller, the first valve based on at least the first portion of the measurement data includes: transmitting a first control output from the electronic controller to the first electric-actuated choke, the first control output being based on at least the first portion of the measurement data; and adjusting the open/closed position of the first electric-actuated choke based on the first control output to thereby actively control the pressure of the wellbore of which the wellhead is the surface termination.

In another exemplary embodiment, the second valve is a second electric-actuated choke, which is in communication with the electronic controller and has an open/closed position; wherein controlling, using the electronic controller, the second valve based on at least the first portion of the measurement and/or the second portion of the measurement data includes: transmitting a second control output from the electronic controller to the second electric-actuated choke, the second control output being based on at least the first portion of the measurement data and/or the second portion of the measurement data; and adjusting the open/closed position of the second electric-actuated choke based on the second control output to thereby actively control the velocity of the wellbore fluid.

In yet another exemplary embodiment, the plurality of sensors includes two or more of the following: a first pressure sensor operably coupled to a first fluid line extending between the wellhead and the first electric-actuated choke; a second pressure sensor operably coupled to a second fluid line extending between the first electric-actuated choke and a first fixed choke; a third pressure sensor operably coupled to a third fluid line extending between the first fixed choke and a second fixed choke; a fourth pressure sensor operably coupled to a fourth fluid line extending between the second fixed choke and the second electric-actuated choke; a fifth pressure sensor operably coupled to a fifth fluid line extending between the second electric-actuated choke and a separator; a sixth pressure sensor operably coupled to a sixth fluid line extending between the separator and a fluid reservoir; a seventh pressure sensor operably coupled to a vent gas line extending from the separator; a hydrocarbon concentration sensor operably coupled to the vent gas line extending from the separator; a flow meter operably coupled to the vent gas line extending from the separator; a level sensor operably coupled to either the separator or the fluid reservoir; and a temperature sensor operably coupled to the first fluid line extending between the wellhead and the first electric-actuated choke.

In fifth aspect, there is provided a system adapted to actively control a plurality of operating parameters associated with wellbore fluid flowing out of a wellhead, the plurality of operating parameters including a velocity of the wellbore fluid, and a pressure of a wellbore of which the wellhead is the surface termination, the system including: a plurality of sensors, each of which is adapted to measure a physical property associated with the wellbore fluid flow; an electronic controller adapted to receive from the plurality of sensors measurement data associated with the respective measurements of the physical properties; and a first valve through which the wellbore fluid is adapted to flow, wherein the first valve is adapted to be in communication with the electronic controller so that the electronic controller is adapted to automatically control the first valve based on at least a first portion of the measurement data to thereby actively control the pressure of the wellbore of which the wellhead is the surface termination; and a second valve adapted to be in fluid communication with the first valve and through which the wellbore fluid is adapted to flow, wherein the second valve is in adapted to be communication with the electronic controller so that the electronic controller is adapted to automatically control the second valve based on at least a first portion of the measurement data and/or a second portion of the measurement data to thereby actively control the velocity of the wellbore fluid.

In an exemplary embodiment, the first valve is a first electric-actuated choke having an open/closed position; wherein the electronic controller is adapted to transmit a first control output to the first electric-actuated choke, the first control output being based on at least the first portion of the measurement data; and wherein the first electric-actuated choke is adapted to adjust its open/closed position, based on the first control output, to thereby actively control the pressure of the wellbore of which the wellhead is the surface termination.

In another exemplary embodiment, the second valve is a second electric-actuated choke having an open/closed position; wherein the electronic controller is adapted to transmit a second control output to the second electric-actuated choke, the second control output being based on at least the first portion of the measurement data and/or the second portion of the measurement data; and wherein the second electric-actuated choke is adapted to adjust its open/closed position, based on the second control output, to thereby actively control the velocity of the wellbore fluid.

In yet another exemplary embodiment, the first and second valves are first and second electric-actuated chokes, respectively; and wherein the system further includes: a first fixed choke adapted to be fluidically positioned between the first and second electric-actuated chokes; and a second fixed choke adapted to be fluidically positioned between the first fixed choke and the second electrical-actuated choke.

In certain exemplary embodiments, the plurality of sensors includes one or more of the following: a first pressure sensor adapted to measure pressure at a location fluidically positioned between the wellbore and the first electric-actuated choke; a second pressure sensor adapted to measure pressure at a location fluidically positioned between the first electric-actuated choke and the first fixed choke; a third pressure sensor adapted to measure pressure at a location fluidically positioned between the first and second fixed chokes; and a fourth pressure sensor adapted to measure pressure at a location fluidically positioned between the second fixed choke and the second electric-actuated choke; and a temperature sensor adapted to measure temperature at a location fluidically positioned between the wellbore and the first electric-actuated choke.

In an exemplary embodiment, the system includes a separator adapted to be in fluid communication with the second electric-actuated choke; a flare stack adapted to be in fluid communication with the separator; and a fluid reservoir adapted to be in fluid communication with the separator.

In another exemplary embodiment, the plurality of sensors includes two or more of the following: a first pressure sensor adapted to measure pressure at a location fluidically positioned between the wellbore and the first electric-actuated choke; a second pressure sensor adapted to measure pressure at a location fluidically positioned between the first electric-actuated choke and the first fixed choke; a third pressure sensor adapted to measure pressure at a location fluidically positioned between the first and second fixed chokes; and a fourth pressure sensor adapted to measure pressure at a location fluidically positioned between the second fixed choke and the second electric-actuated choke; a fifth pressure sensor adapted to measure pressure at a location fluidically positioned between the second electric-actuated choke and the separator; a sixth pressure sensor adapted to measure pressure at a location fluidically positioned between the separator and the fluid reservoir; a seventh pressure sensor adapted to measure pressure at a location fluidically positioned between the separator and the flare stack; a hydrocarbon concentration sensor adapted to measure hydrocarbon concentration in vent gas flowing from the separator to the flare stack; a flow meter adapted to measure the flow rate of the vent gas flowing from the separator to the flare stack; a level sensor adapted to measure a fluid level in either the separator or the fluid reservoir; and a temperature sensor adapted to measure temperature at a location fluidically positioned between the wellbore and the first electric-actuated choke.

In a sixth aspect, there is provided a method of monitoring vent gas separated from a wellbore fluid flowing out of a wellhead, the method including: measuring, using a flow meter, a flow rate of the vent gas; transmitting first measurement data from the flow meter to a controller, the first measurement data being associated with the measurement of the flow rate of the vent gas; measuring, using a hydrocarbon concentration sensor, hydrocarbon concentration in the vent gas; transmitting second measurement data from the hydrocarbon sensor to the controller, the second measurement data being associated with the measurement of the hydrocarbon concentration in the vent gas; and determining, using the controller, one or more operating parameters of the vent gas, wherein the determination of the one or more operating parameters is based on the first measurement data and the second measurement data.

In an exemplary embodiment, the method includes transmitting one or more of the first measurement data, the second measurement data, and parameter data associated with the determination of the one or more operating parameters, from the controller to an electronic drilling recorder (EDR), and/or a computing device, so that the one or more operating parameters are able to monitored at a location located remotely from a vent gas line through which the vent gas flows.

In another exemplary embodiment, the computing device is another controller, which is in communication with one or more electric-actuated chokes, each of the one or more electric-actuated chokes being adapted to control at least one of the following: a pressure of a wellbore of which the wellhead is the surface termination; and a velocity of the wellbore fluid.

In yet another exemplary embodiment, the one or more operating parameters include a cumulative volume of production gas in the vent gas flowing through a vent gas line.

In certain exemplary embodiments, the cumulative volume of production gas in the vent gas flowing through the vent gas line is, or includes, a cumulative volume of methane in the vent gas flowing through the vent gas line.

In an exemplary embodiment, the method includes storing, on the controller, one or more of the first measurement data, the second measurement data, and parameter data associated with the determination of the one or more operating parameters.

In another exemplary embodiment, measuring the hydrocarbon concentration in the vent gas includes measuring methane concentration in the vent gas.

In yet another exemplary embodiment, measuring the hydrocarbon concentration in the vent gas further includes measuring hydrogen sulfide concentration in the vent gas.

In a seventh aspect, there is provided a system adapted to monitor vent gas separated from a wellbore fluid flowing out of a wellhead, the system including: a hydrocarbon concentration sensor adapted to measure hydrocarbon concentration in the vent gas; a flow meter adapted to measure a flow rate of the vent gas; and a controller adapted to be in communication with each of the hydrocarbon concentration sensor and the flow meter; wherein the hydrocarbon concentration sensor is adapted to transmit first measurement data to the controller, the first measurement data being associated with the measurement of the hydrocarbon concentration in the vent gas; wherein the flow meter is adapted to transmit second measurement data to the controller, the second measurement data being associated with the measurement of the flow rate of the vent gas; and wherein the controller is adapted to determine one or more operating parameters of the vent gas, wherein the determination of the one or more operating parameters is based on the first measurement data and the second measurement data.

In an exemplary embodiment, the controller is adapted to transmit one or more of the first measurement data, the second measurement data, and parameter data associated with the determination of the one or more operating parameters, to an electronic drilling recorder (EDR) and/or a computing device so that the one or more operating parameters are able to monitored at a location located remotely from a vent gas line through which the vent gas is adapted to flow.

In another exemplary embodiment, the one or more operating parameters include a cumulative volume of production gas in the vent gas.

In yet another exemplary embodiment, the cumulative volume of production gas in the vent gas is, or includes, a cumulative volume of methane in the vent gas flowing through the vent gas line.

In certain exemplary embodiments, the hydrocarbon concentration sensor includes a methane and hydrogen sulfide sensor adapted to measure methane concentration in the vent gas, and also adapted to measure hydrogen sulfide concentration in the vent gas.

In an exemplary embodiment, the system includes: a fitting to which the hydrocarbon concentration sensor, the controller, and the flow meter are adapted to be connected, the fitting defining an internal fluid passage through which the vent gas is adapted to flow; wherein the hydrocarbon concentration sensor is adapted to be in fluid communication with the internal fluid passage; and wherein the flow meter includes a probe adapted to extend within the internal fluid passage.

In an eighth aspect, there is provided a method of actively controlling one or more operating parameters associated with wellbore fluid flowing in a system, the system including a wellhead out of which the wellbore fluid flows, the one or more operating parameters including a pressure of a wellbore of which the wellhead is the surface termination, the method including: measuring, using one or more sensors, one or more physical properties within the system, the one or more physical properties within the system including least one of the following: a first liquid level within a separator through which the wellbore fluid flows after flowing out of the wellhead; and a second liquid level within a fluid reservoir into which the wellbore fluid flows after flowing out of the wellhead; transmitting measurement data from the one or more sensors to an electronic controller, the measurement data being associated with the respective measurements of the one or more physical properties; and controlling, using the electronic controller, a first valve based on at least a first portion of the measurement data, the control of the first valve actively controlling the pressure of the wellbore.

In an exemplary embodiment, the one or more operating parameters further includes a velocity of the wellbore fluid; and wherein the method further includes: controlling, using the electronic controller, a second valve based on at least: the first portion of the measurement data, and/or a second portion of the measurement data; the control of the second valve actively controlling the velocity of the wellbore fluid.

In another exemplary embodiment, the first and second valves are first and second electric-actuated chokes, respectively.

In a ninth aspect, there is provided a system adapted to actively control one or more operating parameters associated with wellbore fluid flowing out of a wellhead, the one or more operating parameters including a pressure of a wellbore of which the wellhead is the surface termination, the system including: one or more sensors adapted to measure one or more physical properties, the one or more sensors including a level sensor adapted to measure a fluid level within one of: a separator through which the wellbore fluid flows after flowing out of the wellhead, and a fluid reservoir into which the wellbore fluid flows after flowing out of the wellhead; an electronic controller adapted to receive from the one or more sensors measurement data associated with the respective measurements of the one or more physical properties; and a first valve through which the wellbore fluid is adapted to flow, wherein the first valve is adapted to be in communication with the electronic controller so that the electronic controller is adapted to automatically control the first valve based on at least a first portion of the measurement data to thereby actively control the pressure of the wellbore of which the wellhead is the surface termination.

In an exemplary embodiment, the one or more operating parameters further includes a velocity of the wellbore fluid; and wherein the system further includes: a second valve through which the wellbore fluid is adapted to flow, wherein the second valve is adapted to be in communication with the electronic controller so that the electronic controller is adapted to automatically control the second valve based on at least a first portion of the measurement data, and/or a second portion of the measurement data, to thereby actively control the velocity of the wellbore fluid.

In another exemplary embodiment, the first and second valves are first and second electric-actuated chokes, respectively.

In a tenth aspect, there is provided a method of actively controlling one or more operating parameters associated with: a wellbore extending in a subterranean formation, and/or wellbore fluid flowing out of the wellbore and into a system. The system includes a wellhead, the wellhead being a surface termination of the wellbore, and a first valve in fluid communication with the wellhead. The method includes measuring, using one or more sensors, one or more physical properties within the system; transmitting measurement data from the one or more sensors to an electronic controller, the measurement data being associated with the respective measurements of the one or more physical properties; and controlling, using the electronic controller, the first valve based on at least a first portion of the measurement data; wherein the control of the first valve actively controls at least one of the one or more operating parameters; and wherein the active control of the at least one of the one or more operating parameters facilitates: maintenance of the integrity of the wellbore, and/or enhancement of oil and/or gas production out of the wellbore.

In an exemplary embodiment, the wellbore fluid flow out of the wellhead is frac flow-back.

In another exemplary embodiment, the one or more operating parameters include: a velocity of the wellbore fluid, and a pressure of the wellbore; wherein the control of the first valve actively controls the pressure of the wellbore; and wherein the method further includes controlling, using the electronic controller, a second valve based on at least: the first portion of the measurement data, and/or a second portion of the measurement data; wherein the control of the second valve actively controls the velocity of the wellbore fluid.

In yet another exemplary embodiment, the control of the first valve, and the control of the second valve, maintain the integrity of the wellbore and enhance oil and/or gas production out of the wellbore.

In certain exemplary embodiments, the first valve is a first actuated choke, which is in communication with the electronic controller and has an open/closed position; wherein the method further includes reading, using the electronic controller, the measurement data received from the one or more sensors; and wherein controlling, using the electronic controller, the first valve based on at least the first portion of the measurement data includes: transmitting a first control output from the electronic controller to the first actuated choke, the first control output being based on at least the first portion of the measurement data; and adjusting the open/closed position of the first actuated choke based on the first control output.

In an exemplary embodiment, the adjustment of the open/closed position of the first actuated choke actively controls the pressure of the wellbore; wherein the second valve is a second actuated choke, which is in communication with the electronic controller and has an open/closed position; wherein controlling, using the electronic controller, the second valve based on at least the first portion of the measurement and/or the second portion of the measurement data includes: transmitting a second control output from the electronic controller to the second actuated choke, the second control output being based on at least the first portion of the measurement data and/or the second portion of the measurement data; and adjusting the open/closed position of the second actuated choke based on the second control output to actively control the velocity of the wellbore fluid.

In another exemplary embodiment, the one or more sensors include two or more of the following sensors: a first pressure sensor operably coupled to a first fluid line extending between the wellhead and the first actuated choke; a second pressure sensor operably coupled to a second fluid line extending between the first actuated choke and a first fixed choke; a third pressure sensor operably coupled to a third fluid line extending between the first fixed choke and a second fixed choke; a fourth pressure sensor operably coupled to a fourth fluid line extending between the second fixed choke and the second actuated choke; a fifth pressure sensor operably coupled to a fifth fluid line extending between the second actuated choke and a separator; a sixth pressure sensor operably coupled to a sixth fluid line extending between the separator and a fluid reservoir; a level sensor operably coupled to either the separator or the fluid reservoir; a temperature sensor operably coupled to the first fluid line extending between the wellhead and the first actuated choke.

In yet another exemplary embodiment, the one or more physical properties include: a first fluid level within a separator through which the wellbore fluid flows after flowing out of the wellhead; and/or a second fluid level within a fluid reservoir into which at least a portion of the wellbore fluid flows after flowing out of the wellhead.

In certain exemplary embodiments, the one or more operating parameters include a velocity of the wellbore fluid flowing out of the wellhead; wherein the one or more physical properties include a fluid level within a fluid reservoir into which at least a portion of the wellbore fluid is adapted to flow; and wherein the first portion of the measurement data includes measurement data associated with the measurement of the fluid level within the fluid reservoir.

In an exemplary embodiment, the first valve has an open/closed position; wherein an electric actuator is operably coupled to the first valve; and wherein controlling the first valve based on at least a first portion of the measurement data includes: reading, using the electronic controller, the measurement data received from the one or more sensors; transmitting a control output from the electronic controller to the electric actuator, the control output being based on at least the measurement data received from the one or more sensors and read by the electronic controller; and adjusting, using the electric actuator, the open/closed position of the valve based on the control output.

In another exemplary embodiment, the first valve is a choke valve to which the electric actuator is operably coupled; and wherein the choke valve and the electric actuator operably coupled thereto are mounted on, and/or are part of, a choke manifold skid.

In yet another exemplary embodiment, the control output includes one or more electrical control signals.

In certain exemplary embodiments, the electronic controller controls the first valve using: a continuous proportional-integral-derivative (PID) algorithm having a first measured process variable; and/or a discrete PID algorithm having a second measured process variable; and wherein each of the first and second measured process variables is either: a rate of change of the fluid level within a fluid reservoir into which at least a portion of the wellbore fluid flows; or a pressure of the wellbore.

In an exemplary embodiment, the one or more physical properties include a fluid level within a fluid reservoir into which at least a portion of the wellbore fluid flows after flowing out of the wellhead; wherein the one or more sensors include a guided wave level sensor that measures the fluid level within the fluid reservoir; and wherein the at least a portion of the wellbore fluid flows through one or more three-phase separators after flowing through the valve and before flowing into the fluid reservoir.

In an eleventh aspect, there is provided a system adapted to actively control one or more operating parameters associated with: a wellbore extending in a subterranean formation, and/or wellbore fluid flowing out of the wellbore via a wellhead. The system includes one or more sensors, each of which is adapted to measure a physical property associated with the wellbore fluid flow; an electronic controller adapted to receive from the one or more sensors measurement data associated with the respective measurements of the one or more physical properties; and a first valve through which the wellbore fluid is adapted to flow, wherein the first valve is adapted to be in fluid communication with the wellhead, and wherein the first valve is adapted to be in communication with the electronic controller so that the electronic controller is adapted to automatically control the first valve, based on at least a first portion of the measurement data, to actively control at least one of the one or more operating parameters; wherein the active control of the at least one of the one or more operating parameters is adapted to facilitate: maintenance of the integrity of the wellbore, and/or enhancement of oil and/or gas production out of the wellbore.

In an exemplary embodiment, the one or more operating parameters include: a velocity of the wellbore fluid, and a pressure of the wellbore; wherein the control of the first valve actively controls the pressure of the wellbore; and wherein the system further includes a second valve through which the wellbore fluid is adapted to flow; wherein the second valve is adapted to be in communication with the electronic controller so that the electronic controller is adapted to automatically control the second valve based on at least: the first portion of the measurement data, and/or a second portion of the measurement data; and wherein the control of the second valve actively controls the velocity of the wellbore fluid.

In another exemplary embodiment, the first valve is a first actuated choke, which has an open/closed position; wherein the electronic controller is adapted to read the measurement data received from the one or more sensors; and wherein the electronic controller is adapted to transmit a first control output to the first actuated choke, the first control output being based on at least the first portion of the measurement data; and wherein the first actuated choke is adapted to adjust its open/closed position based on the first control output.

In yet another exemplary embodiment, the first actuated choke is adapted to adjust its open/closed position, based on the first control output, to actively control the pressure of the wellbore; wherein the second valve is a second actuated choke, which has an open/closed position; wherein the electronic controller is adapted to transmit a second control output to the second actuated choke, the second control output being based on at least the first portion of the measurement data and/or the second portion of the measurement data; wherein the second actuated choke is adapted to adjust its open/closed position, based on the second control output, to actively control the velocity of the wellbore fluid.

In certain exemplary embodiments, the first and second valves are first and second actuated chokes, respectively; and wherein the system further includes: a first fixed choke adapted to be fluidically positioned between the first and second actuated chokes; and a second fixed choke adapted to be fluidically positioned between the first fixed choke and the second electrical-actuated choke.

In an exemplary embodiment, the one or more sensors include two or more of the following sensors: a first pressure sensor adapted to measure pressure at a location fluidically positioned between the wellbore and the first actuated choke; a second pressure sensor adapted to measure pressure at a location fluidically positioned between the first actuated choke and the first fixed choke; a third pressure sensor adapted to measure pressure at a location fluidically positioned between the first and second fixed chokes; and a fourth pressure sensor adapted to measure pressure at a location fluidically positioned between the second fixed choke and the second actuated choke; a fifth pressure sensor adapted to measure pressure at a location fluidically positioned between the second actuated choke and a separator; a sixth pressure sensor adapted to measure pressure at a location fluidically positioned between the separator and a fluid reservoir; a level sensor adapted to measure a fluid level in either the separator or the fluid reservoir; and a temperature sensor adapted to measure temperature at a location fluidically positioned between the wellbore and the first actuated choke.

In another exemplary embodiment, the system includes an electric actuator operably coupled to the first valve, the first valve having an open/closed position; and wherein the electronic controller is adapted to read the measurement data received from the one or more sensors; wherein the electronic controller is adapted to transmit a control output to the electric actuator, the control output being based on at least the measurement data received from the one or more sensors and read by the electronic controller; and wherein the first valve is adapted to adjust its open/closed position based on the control output.

In yet another exemplary embodiment, the first valve is a choke valve to which the electric actuator is operably coupled; and wherein the choke valve and the electric actuator operably coupled thereto are mounted on, and/or are part of, a choke manifold skid.

In certain exemplary embodiments, the electronic controller is adapted to control the first valve using: a continuous proportional-integral-derivative (PID) algorithm having a first measured process variable; and/or a discrete PID algorithm having a second measured process variable; and wherein each of the first and second measured process variables is either: a rate of change of the fluid level within a fluid reservoir into which at least a portion of the wellbore fluid is adapted to flow; or a pressure of the wellbore.

Other aspects, features, and advantages will become apparent from the following detailed description when taken in conjunction with the accompanying drawings, which are a part of this disclosure and which illustrate, by way of example, principles of the inventions disclosed.

DESCRIPTION OF FIGURES

The accompanying drawings facilitate an understanding of the various embodiments.

DETAILED DESCRIPTION

Figure 1:
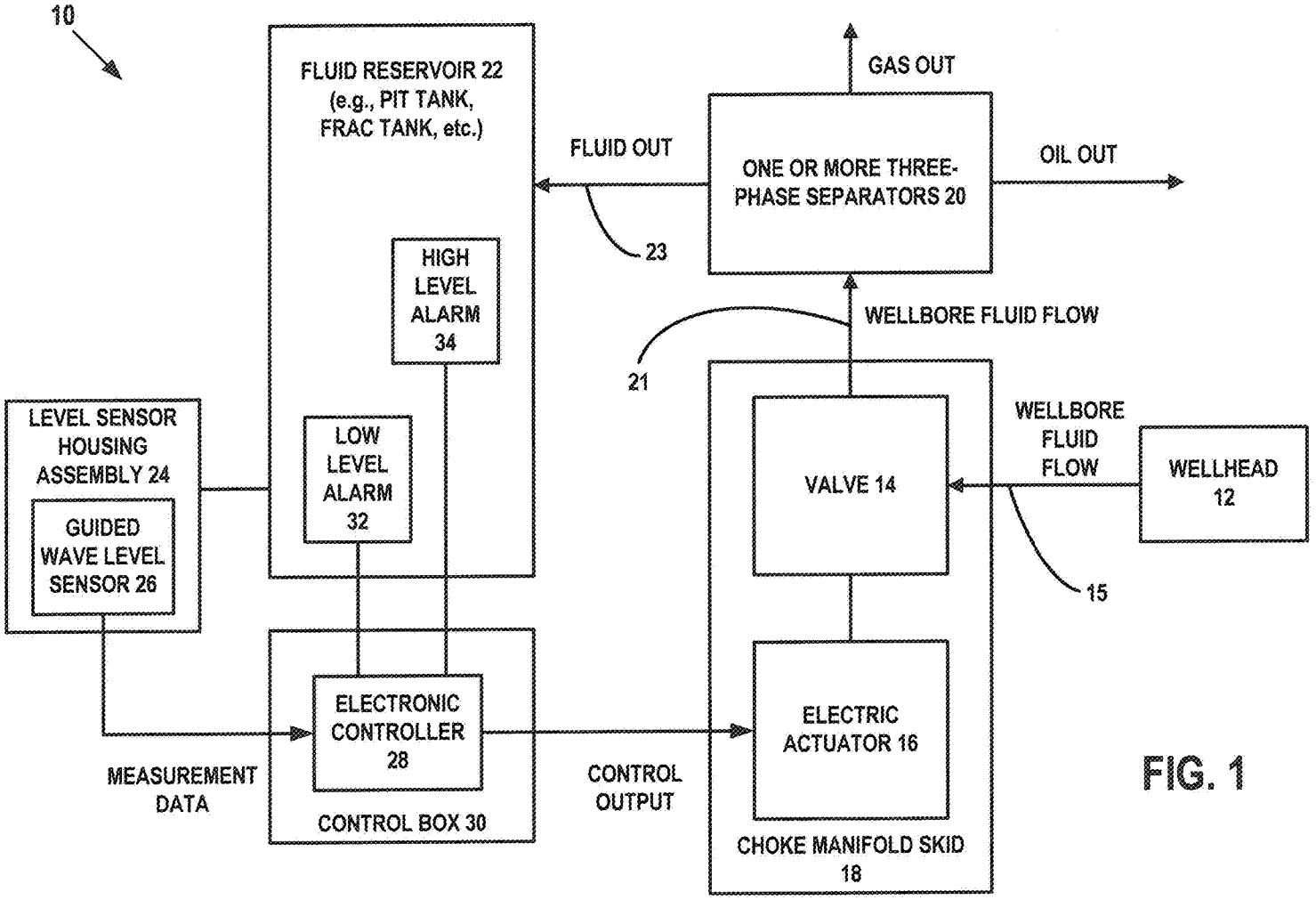
FIG. 1 is a diagrammatic illustration of a system for controlling wellbore fluid flow out of a wellhead, according to an exemplary embodiment.

In an exemplary embodiment, as illustrated in FIG. 1, a system is generally referred to by the reference numeral 10 and includes a wellhead 12 out of which wellbore fluid is adapted to flow. The wellhead 12 is the surface termination of an oil and gas wellbore that extends through one or more subterranean formations. A valve 14 is in fluid communication with the wellhead 12 via at least a fluid line 15. An electric actuator 16 is operably coupled to the valve 14. The valve 14 and the electric actuator 16 operably coupled thereto are associated with a choke manifold skid 18; in several exemplary embodiments, the valve 14 and the electric actuator 16 are associated with the choke manifold skid 18 by being mounted on, and/or a part of, the choke manifold skid 18.

One or more three-phase separators 20 are in fluid communication with the valve 14 via at least a fluid line 21. A fluid reservoir 22 is in fluid communication with the one or more three-phase separators 20 via at least a fluid line 23. In several exemplary embodiments, the fluid reservoir 22 is either a pit tank or a frac tank. A level sensor housing assembly 24 is operably coupled to the fluid reservoir 22. In several exemplary embodiments, the level sensor housing assembly 24 is connected to the fluid reservoir 22. The level sensor housing assembly 24 houses a level sensor, such as a guided wave level sensor 26, which is adapted to measure the fluid level within the fluid reservoir 22.

An electronic controller 28 is in communication with the guided wave level sensor 26. At least a portion of the electronic controller 28 is housed within a control box 30. In several exemplary embodiments, the control box 30 is connected to the fluid reservoir 22. A low level alarm 32 is operably coupled to the fluid reservoir 22, and is in communication with the electronic controller 28. Similarly, a high level alarm 34 is operably coupled to the fluid reservoir 22, and is in communication with the electronic controller 28. In several exemplary embodiments, the alarms 32 and 34 are connected to the fluid reservoir 22. The electronic controller 28 is in communication with the electric actuator 16.

In an exemplary embodiment, the valve 14 is a choke valve. In an exemplary embodiment, the valve 14 is a control valve. In an exemplary embodiment, the valve 14 is a control valve such as, for example, a BV series control valve from Weir Power & Industrial, Lanarkshire, Scotland. In an exemplary embodiment, the valve 14 is a choke valve such as, for example, a Blakeborough Choke Valve from Weir Power & Industrial, Lanarkshire, Scotland. In an exemplary embodiment, the valve 14 is a Mathena Hydraulic Choke Valve from Mathena, Inc., El Reno, Okla.

In an exemplary embodiment, the electric actuator 16 includes an exemplary embodiment of an electric actuator disclosed in U.S. Application No. 62/180,735, filed Jun. 17, 2015, the entire disclosure of which is hereby incorporated herein by reference. In an exemplary embodiment, the electric actuator 16 includes, in whole or in part, one or more exemplary embodiments of an electric actuator disclosed in U.S. Application No. 62/180,735, filed Jun. 17, 2015, the entire disclosure of which is hereby incorporated herein by reference. In several exemplary embodiments, the electric actuator 16 includes a linear roller screw assembly.

In an exemplary embodiment, the combination of the valve 14 and the electric actuator 16 includes an exemplary embodiment of a choke apparatus disclosed in U.S. Application No. 62/180,735, filed Jun. 17, 2015, the entire disclosure of which is hereby incorporated herein by reference. In an exemplary embodiment, the combination of the valve 14 and the electric actuator 16 includes, in whole or in part, one or more exemplary embodiments of a choke apparatus disclosed in U.S. Application No. 62/180,735, filed Jun. 17, 2015, the entire disclosure of which is hereby incorporated herein by reference.

In several exemplary embodiments, the combination of the valve 14 and the electric actuator 16 is configured to provide the ability to effectively make flow area changes with greater sensitivity than 1/64-inch fixed orifice bean changes. In several exemplary embodiments, the combination of the valve 14 and the electric actuator 16 is configured to control effective flow area to less than 0.005 square inch.

In several exemplary embodiments, the guided wave level sensor 26 is, includes, or is part of, a Magnetrol® Eclipse® Model 706 high performance guided wave radar level transmitter, which is available from Magnetrol International, Incorporated, Downers Grove, Ill. In an exemplary embodiment, the guided wave level sensor 26 includes a rod-shaped probe, which extends within at least a portion of the level sensor housing assembly 24.

In several exemplary embodiments, the electronic controller 28 includes one or more processors, a non-transitory computer readable medium operably coupled to the one or more processors, and a plurality of instructions stored on the non-transitory computer readable medium, the instructions being accessible to, and executable by, the one or more processors. In several exemplary embodiments, the electronic controller 28 is, includes, or is part of, a programmable logic controller (PLC). In several exemplary embodiments, the electronic controller 28 is, includes, or is part of, a programmable logic controller from the CP1 family of compact machine controllers, which are available from the Omron Corporation, Tokyo, Japan.

In an exemplary embodiment, the low level alarm 32 is a strobe light high level light/alarm. In an exemplary embodiment, the low level alarm 34 is a strobe light low level light/alarm.

In operation, in an exemplary embodiment, wellbore fluid flows out of the wellhead 12. In an exemplary embodiment, the wellbore fluid flow out of the wellhead 12 is part of a hydraulic fracturing operation; the wellbore fluid flow may be referred to as "frac flow-back" with the fluid itself being referred to as "flow-back." In an exemplary embodiment, the wellbore fluid flow out of the wellhead 12 is part of a well testing operation. In several exemplary embodiments, the wellbore fluid flow out of the wellhead 12 is part of another operation that is neither a hydraulic fracturing operation nor a well testing operation. In several exemplary embodiments, the wellbore fluid flowing out of the wellhead 12 is a multiphase flow. In several exemplary embodiments, the wellbore fluid flowing out of the wellhead 12 includes solid, liquid, and gas materials. In several exemplary embodiments, the wellbore fluid flowing out of the wellhead 12 includes water and/or other fluids having free gas therewithin, as well as sand and/or other solid materials. In several exemplary embodiments, the wellbore fluid flowing out of the wellhead 12 is a slurry that includes at least liquid and solid materials and, in several exemplary embodiments, gas materials.

The wellbore fluid flows from the wellhead 12 and to the valve 14 via at least the fluid line 15. The wellbore fluid flows through the valve 14. The valve 14 controls the volumetric flow rate, and thus the velocity, of the wellbore fluid flowing out of the wellhead 12. More particularly, if the valve 14 is opened further, the volumetric flow rate increases and thus the velocity increases; conversely, if the valve 14 is closed further, the volumetric flow rate decreases and thus the velocity decreases. The valve 14 also controls the surface pressure of the wellbore of which the wellhead 12 is the surface termination.

The wellbore fluid flows through the valve 14 and to the one or more three-phase separators 20 via at least the fluid line 21. In several exemplary embodiments, as shown in FIG. 1, the one or more three-phase separators 20 separate gas materials from the wellbore fluid flow, and also separate oil from the wellbore fluid flow. In several exemplary embodiments, the one or more three-phase separators 20 separate sand and/or other solid materials from the wellbore fluid flow (this separation operation is not shown in FIG. 1). The remaining liquid and, in several exemplary embodiments, solid materials, flow out of the one or more three-phase separators 20 and into the fluid reservoir 22 via at least the fluid line 23.

The guided wave level sensor 26 measures the fluid level within the fluid reservoir 22 and communicates data associated with the measurement to the electronic controller 28. The electronic controller 28 reads the data and, in turn, automatically controls the electric actuator 16, which opens the valve 14, further opens the valve 14, further closes the valve 14, or maintains the open/closed position of the valve 14, based on the measurement data received from the guided wave level sensor 26; thus, the electronic controller 28 automatically controls the valve 14. This automatic control of the valve 14 automatically controls the volumetric flow rate, and thus the velocity, of the wellbore fluid flowing out of the wellhead 12, and automatically controls the surface pressure of the wellbore of which the wellhead 12 is the surface termination.

In an exemplary embodiment, the electronic controller 28 automatically controls the valve 14, in accordance with the foregoing, at least in part by: calculating the volume of fluid within the fluid reservoir 22; calculating a rate of change of the volume of fluid within the fluid reservoir 22; and, using the calculated volume of fluid within the fluid reservoir 22 and/or the calculated rate of change of the volume of fluid within the fluid reservoir 22, calculating the volumetric flow rate, the flow back velocity, and/or another operating parameter of the wellbore fluid flowing out of the wellhead 12. In an exemplary embodiment, to calculate the volume of fluid within the fluid reservoir 22, the electronic controller 28 uses a table and/or a predetermined mathematical function/equation, either or both of which is stored in a computer readable medium of the electronic controller 28 and/or another computer readable medium, to determine the volume based on the fluid level measurement made by the guided wave level sensor 26; in several exemplary embodiments, the table is a volume-vs.-fluid level linearization table the data points for which are based on, or supplied by, the vendor of the fluid reservoir 22; in several exemplary embodiments, the table itself is a list of level values correlated to respective volume values. In several exemplary embodiments, the predetermined mathematical function/equation is determined using data points from the linearization table; as a result, the predetermined mathematical function/equation yields an accurate volume calculation based on a fluid level measurement, regardless of whether that fluid level measurement is a data point based on, or supplied by, the vendor of the fluid reservoir 22 and/or whether that fluid level measurement is a data point in the table.

In an exemplary embodiment, the electronic controller 28 automatically controls the valve 14, in accordance with the foregoing, using a continuous proportional-integral-derivative (PID) algorithm, the PID algorithm having as its measured process variable the rate of change of the fluid level within the fluid reservoir 22; in several exemplary embodiments, this continuous PID algorithm is, or is part of, a computer program stored in the electronic controller 28, which executes the computer program during the above-described operation of the system 10.

In an exemplary embodiment, the electronic controller 28 automatically controls the valve 14, in accordance with the foregoing, using a continuous PID algorithm, the PID algorithm having as its measured process variable the pressure of the wellbore of which the wellhead 12 is the surface termination; in several exemplary embodiments, this continuous PID algorithm is, or is part of, a computer program stored in the electronic controller 28, which executes the computer program during the above-described operation of the system 10.

In an exemplary embodiment, the electronic controller 28 automatically controls the valve 14, in accordance with the foregoing, using a discrete PID algorithm, the PID algorithm having as its measured process variable the rate of change of the fluid level within the fluid reservoir 22; in several exemplary embodiments, this discrete PID algorithm is, or is part of, a computer program stored in the electronic controller 28, which executes the computer program during the above-described operation of the system 10.

In an exemplary embodiment, the electronic controller 28 automatically controls the valve 14, in accordance with the foregoing, using a discrete PID algorithm, the PID algorithm having as its measured process variable the pressure of the wellbore of which the wellhead 12 is the surface termination; in several exemplary embodiments, this discrete PID algorithm is, or is part of, a computer program stored in the electronic controller 28, which executes the computer program during the above-described operation of the system 10.

In several exemplary embodiments, the combination of the guided wave level sensor 26, the electronic controller 28, the electric actuator 16, and the valve 14 actively controls wellbore surface pressure and flow-back volumetric flow rates (and flow-back velocities); that is, the combination actively controls the surface pressure of the wellbore of which the wellhead 12 is the surface termination, as well as the volumetric flow rate, and thus the velocity, of the wellbore fluid flowing out of the wellhead 12. The system 10 provides real-time measurements of the volume of fluid in the fluid reservoir 22, and provides real-time measurements of volume changes within the fluid reservoir 22. In several exemplary embodiments, the system 10 provides real-time level change analysis and communication for monitoring, decision making, and intelligent control. In several exemplary embodiments, the guided wave level sensor 26 provides level and flow rate data. In several exemplary embodiments, the electronic controller 28 provides local data storage thereon, and/or includes a web-enabled data portal. In several exemplary embodiments, the electronic controller 28 is in communication with, via a network, one or more computing devices, each of which is located either at the site where the wellhead 12 is located or at a remote location such as, for example, a centralized operation system; via the network, the electronic controller 28 transmits data (e.g., volumetric flow rate data, fluid level data, fluid volume data, rate of change of fluid volume data, etc.) to the one or more computing devices. In several exemplary embodiments, the system 10 provides intelligent alarms with respect to fluid level within the fluid reservoir 22, volumetric flow rate of the wellbore fluid flowing from the wellhead 12, actual flow rate versus target flow rate, flow rate versus choke position, other logic and relationship-based alarms, or any combination thereof.

In several exemplary embodiments, the system 10 intelligently controls wellbore flow during frac flow-back and well testing operations. In several exemplary embodiments, the system 10 enables the customization of a targeted flow-back profile, while maintaining a predetermined volumetric flow rate over specific time periods such as, for example, every hour, every 30 minutes, every few minutes, etc. In several exemplary embodiments, the system 10 enables the customization of a targeted flow-back profile, while maintaining a predetermined volumetric flow rate within a predetermined percentage such as, for example, +/−10%, over specific time periods such as, for example, every hour, every 30 minutes, every few minutes, etc.

In several exemplary embodiments, the system 10 provides precision flow control, providing the ability to adjust effective flow area with greater sensitivity than incremental fixed orifices, or "beans," which may be positioned upstream of the fluid reservoir 22 to control the volumetric flow rate of the wellbore fluid from the wellhead 12 to the fluid reservoir 22. In several exemplary embodiments, the valve 14, and the automatic control thereof, provide the ability to effectively make flow area changes with greater sensitivity than 1/64-inch fixed orifice bean changes. In several exemplary embodiments, the characterization of the valve 14 provides flow rate versus choke position, including $64^{th}$ orifice equivalents. In several exemplary embodiments, the valve 14, and the automatic control thereof, provide the ability to control effective flow area to less than 0.005 square inch, which is less than a $1/64^{th}$-inch (0.016-inch) fixed orifice bean change.

In several exemplary embodiments, using the system 10, the flow coefficient Cv of the flow-back can be controlled within a predetermined percentage such as, for example, +/−5%. In several exemplary embodiments, using the system 10, the response time for incremental adjustments is less than 0.05 inch per second. In several exemplary embodiments, the electronic controller 28 is programmed for greater speed control.

In several exemplary embodiments, the system 10 provides precise flow control, which allows for tighter flow control "windows" such as, for example, a flow-back volumetric flow rate window that ranges from a predetermined minimum volumetric flow rate to a predetermined maximum volumetric flow rate.

In several exemplary embodiments, the above-described data communication between the electronic controller 28 and one or more computing devices allows for trend analysis and the development of operational standards.

In several exemplary embodiments, the system 10 actively controls the wellbore fluid flow out of the wellhead 12 to maintain the integrity of the wellbore of which the wellhead 12 is the surface termination. In several exemplary embodiments, the system 10 ensures that the wellbore fluid flow rate is not too fast, thereby reducing the risk of the wellbore collapsing. In several exemplary embodiments, the system 10 ensures that the wellbore fluid flow rate is not too slow, thereby reducing the risk of the wellbore clogging. In several exemplary embodiments, the system 10 provides active monitoring and management of well completions, positively impacting overall wellbore integrity and ultimately enhancing oil and/or gas production out of the wellbore. In several exemplary embodiments, the system 10 may be configured to enhance wellbore production by maximizing initial oil and/or gas production, total oil and/or gas production, or a combination of initial oil and/or gas production and total oil and/or gas production.

During operation, in several exemplary embodiments, if the electronic controller 28 determines that the fluid level within the fluid reservoir 22 is too high (i.e., is at, or exceeds, a predetermined high level), the electronic controller 28 activates the high level alarm 34. During operation, in an exemplary embodiment, if the electronic controller 28 determines that the fluid level within the fluid reservoir 22 is too low (i.e., is at, or is below, another predetermined low level), the electronic controller 28 activates the low level alarm 32. During operation, in an exemplary embodiment, if the high level alarm 34 determines that the fluid level within the fluid reservoir 22 is too high (i.e., is at, or exceeds, a predetermined high level), the high level alarm 34 activates itself and/or communicates with the electronic controller 28, which then activates the high level alarm 34. During operation, in an exemplary embodiment, if the low level alarm 32 determines that the fluid level within the fluid reservoir 22 is too low (i.e., is at, or is below, another predetermined low level), the low level alarm 32 activates itself and/or communicates with the electronic controller 28, which then activates the low level alarm 32.

In several exemplary embodiments, the system 10 includes a flow meter operably coupled to the fluid line 15 to measure the volumetric flow rate and/or flow back velocity of the wellbore fluid flowing out of the wellhead 12, and/or a flow meter operably coupled to the fluid line 21 to measure the volumetric flow rate and/or flow back velocity of the wellbore fluid flowing out of the wellhead 12; in several exemplary embodiments, such flow meter(s) are in communication with the electronic controller 28, which uses data received from such flow meter(s) to control the wellbore fluid flowing out of the wellhead 12.

Figure 2:
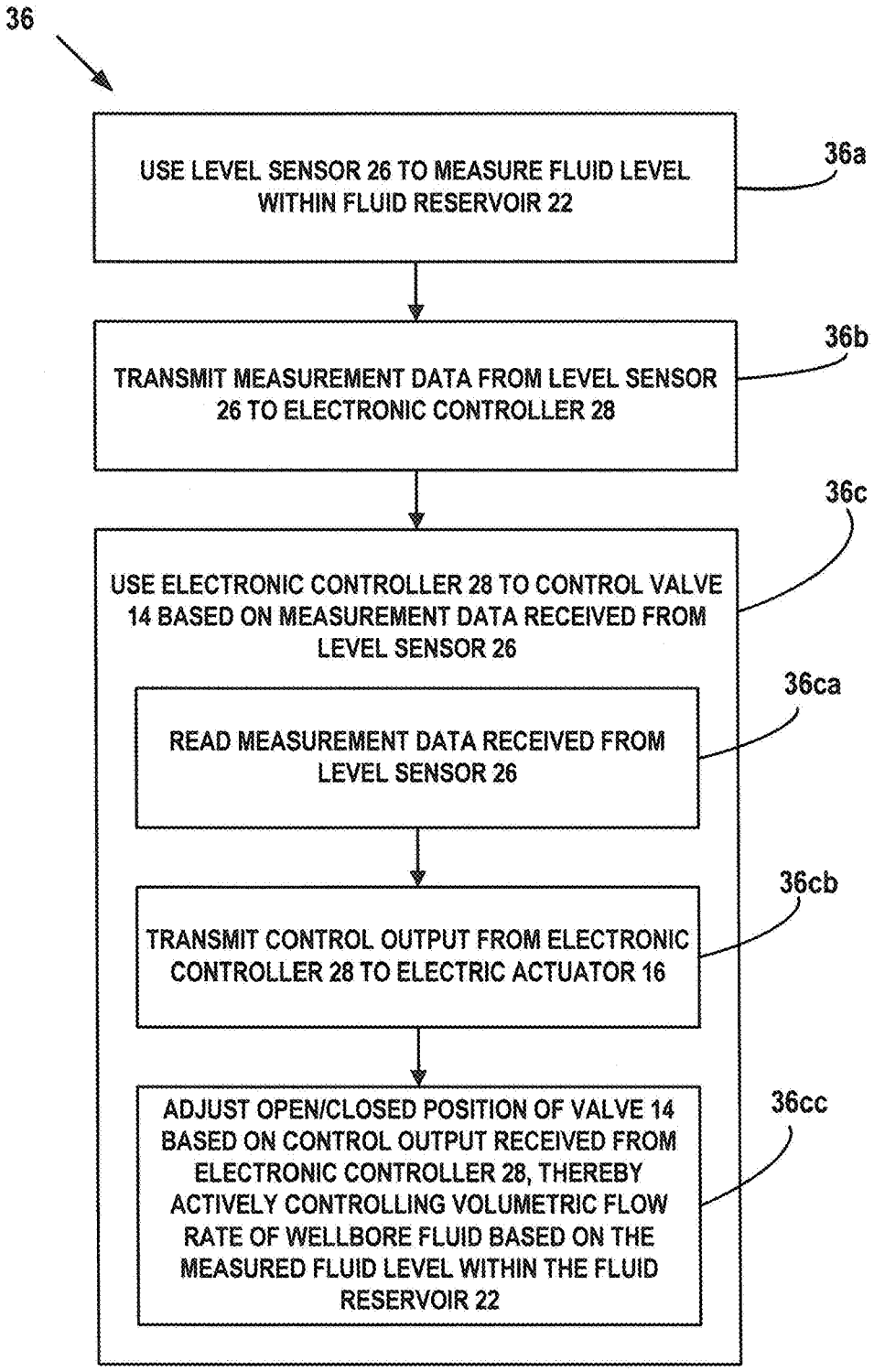
FIG. 2 is a flow chart illustration of a method executed using the system of FIG. 1, according to an exemplary embodiment.

In an exemplary embodiment, as illustrated in FIG. 2 with continuing reference to FIG. 1, a method is generally referred to by the reference numeral 36. The method 36 is a method of actively controlling a volumetric flow rate of a wellbore fluid flowing out of a wellhead, through at least a valve, and into a fluid reservoir. In several exemplary embodiments, the method 36 is executed using in whole or in part the system 10 of FIG. 1, with the wellbore fluid flowing out of the wellhead 12, through the valve 14, and into the fluid reservoir 22.

As shown in FIG. 2, the method 36 includes a step 36*a*, at which the guided wave level sensor 26 is used to measure the fluid level within the fluid reservoir 22. At step 36*b*, measurement data is transmitted from the guided wave level sensor 26 to the electronic controller 28, the measurement data being associated with the measurement of the fluid level within the fluid reservoir 22 at the step 36*a*. At step 36*c*, the electronic controller 28 is used to control the valve 14 based on the measurement data received at the step 36*b*.

In an exemplary embodiment, as shown in FIG. 2, the step 36*c* includes a step 36*ca*, at which the electronic controller 28 is used to read the measurement data received at the step 36*b*. At step 36*cb*, a control output is transmitted from the electronic controller 28 to the electric actuator 16, the control output being based on the measurement data received at the step 36*b* and read by the electronic controller at the step 36*cb*. In several exemplary embodiments, the electronic controller 28 analyzes and/or processes the measurement data read at the step 36*ca* to determine the control output to be transmitted at the step 36*cb*. In an exemplary embodiment, the control output transmitted at the step 36*cb* includes one or more electrical control signals, which are received by the electric actuator 16. In an exemplary embodiment, the control output transmitted at the step 36*cb* includes control data received by the electric actuator 16.

At step 36*cc*, the electric actuator 16 adjusts the open/closed position of the valve 14 based on the control output transmitted at the step 36*cb*. As a result, the volumetric flow rate of the wellbore fluid flowing out of the wellhead 12 is actively controlled based on the measured fluid level within the fluid reservoir 22. In several exemplary embodiments, the step 36*cc* is omitted if the electronic controller 28 determines that no adjustments to the volumetric flow rate of the wellbore fluid are necessary and thus determines that the current open/closed position of the valve 14 should be maintained. In several exemplary embodiments, the steps 36*cb* and 36*cc* are omitted if the electronic controller 28 determines that no adjustments to the volumetric flow rate of the wellbore fluid are necessary, and thus determines that the current open/closed position of the valve 14 should be maintained.

In an exemplary embodiment, at the step 36*c*, the electronic controller 28 automatically controls the valve 14, in accordance with the foregoing, using a continuous proportional-integral-derivative (PID) algorithm, the PID algorithm having as its measured process variable the rate of change of the fluid level within the fluid reservoir 22; in several exemplary embodiments, this continuous PID algorithm is, or is part of, a computer program stored in the electronic controller 28, which executes the computer program during the above-described operation of the system 10. In an exemplary embodiment, at the step 36*c*, the electronic controller 28 automatically controls the valve 14, in accordance with the foregoing, using a continuous PID algorithm, the PID algorithm having as its measured process variable the pressure of the wellbore of which the wellhead 12 is the surface termination; in several exemplary embodiments, this continuous PID algorithm is, or is part of, a computer program stored in the electronic controller 28, which executes the computer program during the above-described operation of the system 10. In an exemplary embodiment, at the step 36*c*, the electronic controller 28 automatically controls the valve 14, in accordance with the foregoing, using a discrete PID algorithm, the PID algorithm having as its measured process variable the rate of change of the fluid level within the fluid reservoir 22; in several exemplary embodiments, this discrete PID algorithm is, or is part of, a computer program stored in the electronic controller 28, which executes the computer program during the above-described operation of the system 10. In an exemplary embodiment, at the step 36*c*, the electronic controller 28 automatically controls the valve 14, in accordance with the foregoing, using a discrete PID algorithm, the PID algorithm having as its measured process variable the pressure of the wellbore of which the wellhead 12 is the surface termination; in several exemplary embodiments, this discrete PID algorithm is, or is part of, a computer program stored in the electronic controller 28, which executes the computer program during the above-described operation of the system 10.

In several exemplary embodiments, execution of the method 36 actively controls the surface pressure of the wellbore of which the wellhead 12 is the surface termination, as well as the volumetric flow rate of the wellbore fluid flowing out of the wellhead 12. Execution of the method 36 provides real-time measurements of the volume of fluid in the fluid reservoir 22, and provides real-time measurements of volume changes within the fluid reservoir 22. In several exemplary embodiments, execution of the method 36 provides real-time level change analysis and communication for monitoring, decision making, and intelligent control. In several exemplary embodiments, execution of the method 36 intelligently controls wellbore flow during frac flow-back and well testing operations. In several exemplary embodiments, execution of the method 36 enables the customization of a targeted flow-back profile, while maintaining a predetermined volumetric flow rate over specific time periods such as, for example, every hour, every 30 minutes, every few minutes, etc. In several exemplary embodiments, execution of the method 36 enables the customization of a targeted flow-back profile, while maintaining a predetermined volumetric flow rate within a predetermined percentage such as, for example, +/−10%, over specific time periods such as, for example, every hour, every 30 minutes, every few minutes, etc. In several exemplary embodiments, execution of the method 36 provides precision flow control, providing the ability to adjust effective flow area with greater sensitivity than incremental fixed orifices, or "beans," which may be positioned upstream of the fluid reservoir 22 to control the volumetric flow rate of the wellbore fluid from the wellhead 12 to the fluid reservoir 22. In several exemplary embodiments, execution of the method 36 provides precise flow control, which allows for tighter flow control "windows" such as, for example, a flow-back volumetric flow rate window that ranges from a predetermined minimum volumetric flow rate to a predetermined maximum volumetric flow rate. In several exemplary embodiments, execution of the method 36 actively controls the wellbore fluid flow out of the wellhead 12 to maintain the integrity of the wellbore of which the wellhead 12 is the surface termination. In several exemplary embodiments, execution of the method 36 ensures that the wellbore fluid flow rate is not too fast, thereby reducing the risk of the wellbore collapsing. In several exemplary embodiments, execution of the method 36 ensures that the wellbore fluid flow rate is not too slow, thereby reducing the risk of the wellbore clogging. In several exemplary embodiments, execution of the method 36 provides active monitoring and management of well completions, positively impacting overall wellbore integrity and ultimately enhancing oil and/or gas production out of the wellbore. In several exemplary embodiments, execution of the method 36 may be configured to enhance wellbore production by maximizing initial oil and/or gas production, total oil and/or gas production, or a combination of initial oil and/or gas production and total oil and/or gas production.

Figure 3:
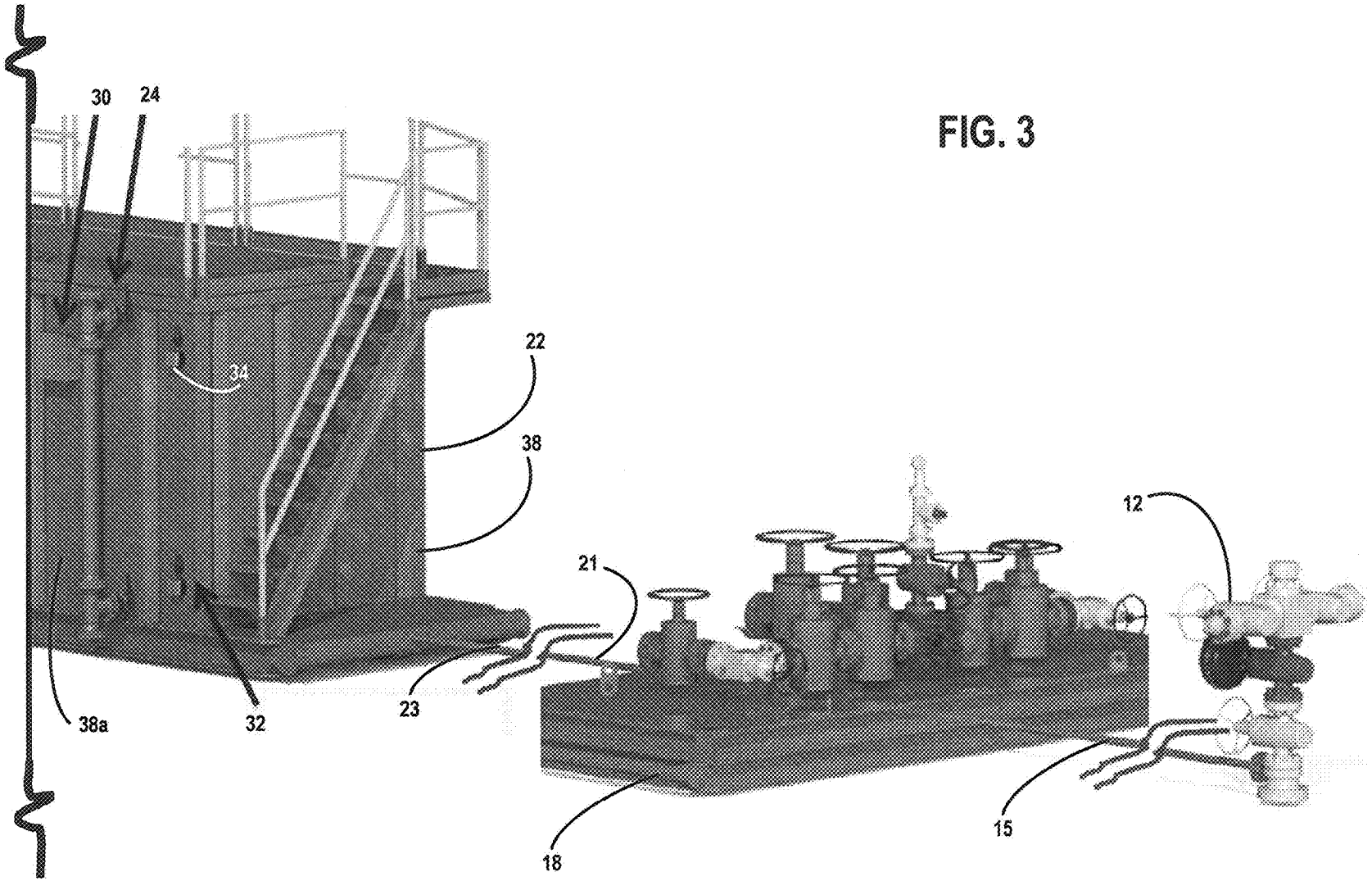
FIG. 3 is a perspective view of a portion of the system of FIG. 1, according to an exemplary embodiment.

In an exemplary embodiment, a portion of the system 10 is illustrated in FIG. 3. As shown in FIG. 3, with continuing reference to FIGS. 1 and 2, the fluid reservoir 22 includes a frac tank 38, and each of the level sensor housing assembly 24, the control box 30, the low level alarm 32, and the high level alarm 34 is mounted on a vertically-extending side 38*a* of the frac tank 38. The fluid line 23 is connected to the frac tank 38. The one or more three-phase separators 20 are omitted from view in FIG. 3. In several exemplary embodiments, the one or more three-phase separators 20 are omitted from the system 10.

Figure 4:
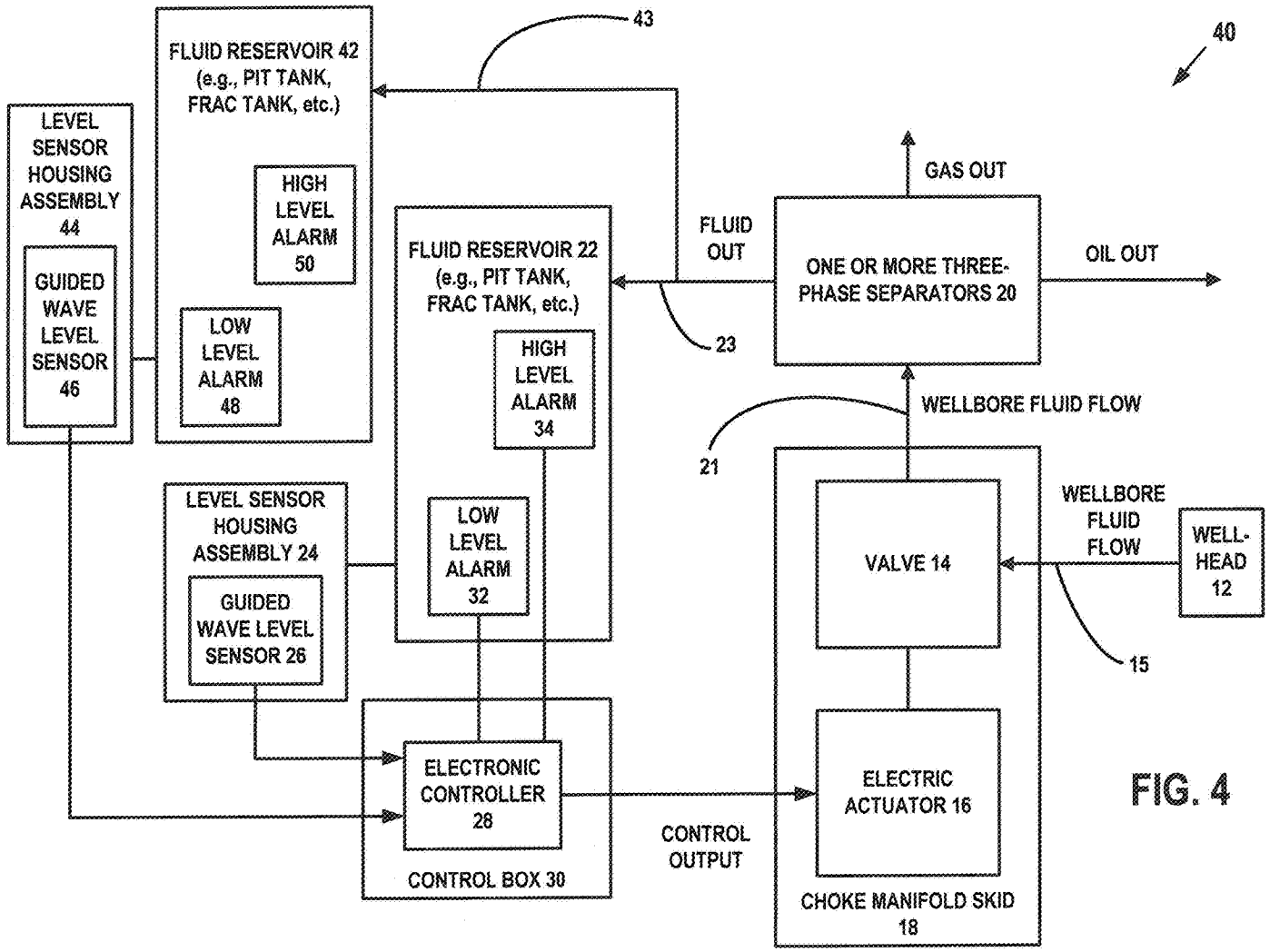
FIG. 4 is a diagrammatic illustration of a system for controlling wellbore fluid flow out of a wellhead, according to another exemplary embodiment.

In an exemplary embodiment, as illustrated in FIG. 4 with continuing reference to FIGS. 1-3, a system is generally referred to by the reference numeral 40. The system 40 includes all of the components of the system 10, which components are given the same reference numerals. As shown in FIG. 4, the system 40 further includes a fluid reservoir 42 in fluid communication with the one or more three-phase separators 20 via at least the fluid line 23 and a fluid line 43, which is fluidically coupled between the fluid line 23 and the fluid reservoir 42. A level sensor housing assembly 44 is operably coupled to the fluid reservoir 42. In several exemplary embodiments, the level sensor housing assembly 44 is connected to the fluid reservoir 42. The level sensor housing assembly 44 houses a level sensor, such as a guided wave level sensor 46, which is adapted to measure the fluid level within the fluid reservoir 42. The guided wave level sensor 46 is in communication with the electronic controller 28. A low level alarm 48 is operably coupled to the fluid reservoir 42, and is in communication with the electronic controller 28. Similarly, a high level alarm 50 is operably coupled to the fluid reservoir 42, and is in communication with the electronic controller 28. In several exemplary embodiments, the alarms 48 and 50 are connected to the fluid reservoir 42. In several exemplary embodiments, the alarms 48 and 50 are identical to the alarms 32 and 34, respectively.

In operation, in an exemplary embodiment, wellbore fluid flows out of the wellhead 12. The wellbore fluid flows from the wellhead 12 and to the valve 14 via at least the fluid line 15. The wellbore fluid flows through the valve 14. The valve 14 controls the volumetric flow rate of the wellbore fluid flowing out of the wellhead 12. The valve 14 also controls the surface pressure of the wellbore of which the wellhead 12 is the surface termination.

The wellbore fluid flows through the valve 14 and to the one or more three-phase separators 20 via at least the fluid line 21. In several exemplary embodiments, as shown in FIG. 4, the one or more three-phase separators 20 separate gas materials from the wellbore fluid flow, and also separate oil from the wellbore fluid flow. In several exemplary embodiments, the one or more three-phase separators 20 separate sand and/or other solid materials from the wellbore fluid flow (this separation operation is not shown in FIG. 4). The remaining liquid materials and, in several exemplary embodiments, remaining solid materials, flow out of the one or more three-phase separators 20. A portion of these remaining materials flow into the fluid reservoir 22, via at least the fluid line 23, and another portion of these remaining materials flow into the fluid reservoir 46 via at least the fluid lines 23 and 43.

The guided wave level sensor 26 measures the fluid level within the fluid reservoir 22 and communicates data associated with the measurement to the electronic controller 28. Likewise, the guided wave level sensor 46 measures the fluid level within the fluid reservoir 42 and communicates data associated with the measurement to the electronic controller 28. The electronic controller 28 reads the measurement data received from the guided wave level sensors 26 and 46 and, in turn, automatically controls the electric actuator 16, which opens the valve 14, further opens the valve 14, further closes the valve 14, or maintains the open/closed position of the valve 14, based on the measurement data received from the guided wave level sensors 26 and 46; thus, the electronic controller 28 automatically controls the valve 14. This automatic control of the valve 14 automatically controls the volumetric flow rate of the wellbore fluid flowing out of the wellhead 12, and automatically controls the surface pressure of the wellbore of which the wellhead 12 is the surface termination.

In several exemplary embodiments, the use of measurement data from each of the guided wave level sensors 26 and 46 increases the degree to which the wellbore fluid flow is precisely controlled.

In several exemplary embodiments, the combination of the guided wave level sensors 26 and 46, the electronic controller 28, the electric actuator 16, and the valve 14 actively controls wellbore surface pressure and flow-back volumetric flow rates; that is, the combination actively controls the surface pressure of the wellbore of which the wellhead 12 is the surface termination, as well as the volumetric flow rate of the wellbore fluid flowing out of the wellhead 12.

In several exemplary embodiments, the method 36 is executed using the system 40; in such exemplary embodiments, the step 36*c* may include using the electronic controller 28 to control the valve 14 based on measurement data received from the level sensor 26 and measurement data received from the level sensor 46, the step 36*ca* may include reading measurement data received from the level sensor 26 and reading measurement data received from the level sensor 46, and the volumetric flow rate of the wellbore fluid may be actively controlled based on the measured fluid level within the fluid reservoir 22 and the measured fluid level within the fluid reservoir 42.

In several exemplary embodiments, another control box housing an electronic controller is associated with the fluid reservoir 42, and the guided wave level sensor 46 communicates data to this electronic controller which, in turn, communicates to the electronic controller 28 data associated with the fluid level measurement by the guided wave level sensor 46. In several exemplary embodiments, the electronic controller 28 controls the operation of another electronic controller associated with the fluid reservoir 42. In several exemplary embodiments, one or more remotely-located computing devices control the electronic controller 28 and/or other electronic controller(s) positioned at the well site where the wellhead 12 is positioned.

In several exemplary embodiments, instead of, or in addition to, the valve 14, the system 40 includes one or more other valves such as, for example, a valve fluidically coupled between the fluid reservoir 22 and the one or more three-phase separators 20, a valve fluidically coupled between the fluid reservoir 42 and the fluid line 23, a valve fluidically coupled in-line with the fluid line 21, or any combination thereof in several exemplary embodiments, each of these additional valves may be operably coupled to an individual electric actuator which, in turn, may be in communication with the electronic controller 28.

In several exemplary embodiments, the system 40 includes a flow meter operably coupled to the fluid line 15 to measure the volumetric flow rate and/or flow back velocity of the wellbore fluid flowing out of the wellhead 12, and/or a flow meter operably coupled to the fluid line 21 to measure the volumetric flow rate and/or flow back velocity of the wellbore fluid flowing out of the wellhead 12; in several exemplary embodiments, such flow meter(s) are in communication with the electronic controller 28, which uses data received from such flow meter(s) to control the wellbore fluid flowing out of the wellhead 12.

In several exemplary embodiments, a plurality of instructions, or computer program(s), are stored on a non-transitory computer readable medium, the instructions or computer program(s) being accessible to, and executable by, one or more processors. In several exemplary embodiments, the one or more processors execute the plurality of instructions (or computer program(s)) to operate in whole or in part the above-described exemplary embodiments. In several exemplary embodiments, the one or more processors are part of the electronic controller 28, the guided wave level sensor 26, the guided wave level sensor 46, one or more other electronic controllers, one or more other computing devices, or any combination thereof. In several exemplary embodiments, the non-transitory computer readable medium is part of the electronic controller 28, the guided wave level sensor 26, the guided wave level sensor 46, one or more other electronic controllers, one or more other computing devices, or any combination thereof.

Figure 5:
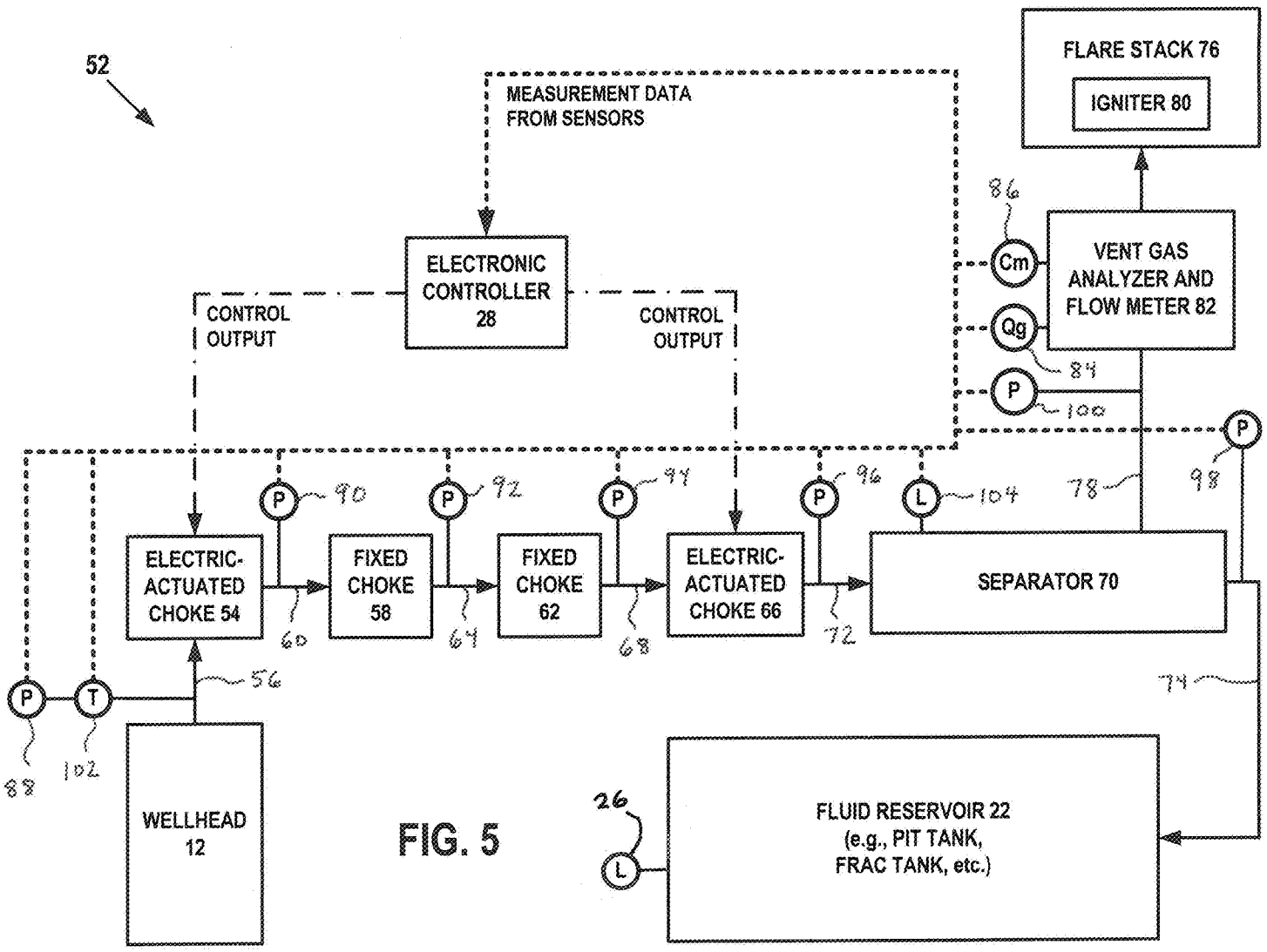
FIG. 5 is a diagrammatic illustration of a system for controlling wellbore fluid flow out of a wellhead according to yet another exemplary embodiment, the system including a vent gas analyzer and flow meter.

In an exemplary embodiment, as illustrated in FIG. 5 with continuing reference to FIGS. 1-4, a system is generally referred to by the reference numeral 52. The system 52 includes some of the components of the systems 10 and 40, which components are given the same reference numerals. As shown in FIG. 5, the system 52 includes a valve, such as an electric-actuated choke 54, which is in fluid communication with the wellhead 12 via a fluid line 56. A fixed choke 58 is in fluid communication with the electric-actuated choke 54 via a fluid line 60. A fixed choke 62 is in fluid communication with the fixed choke 58 via a fluid line 64.

A valve, such as an electric-actuated choke 66, is in fluid communication with the fixed choke 62 via a fluid line 68; thus, the fixed choke 58 is fluidically positioned between the electric-actuated chokes 54 and 66, and the fixed choke 62 is fluidically positioned between the fixed choke 58 and the electric-actuated choke 66. A separator 70 is in fluid communication with the electric-actuated choke 66 via a fluid line 72. The fluid reservoir 22 is in fluid communication with the separator 70 via a fluid line 74. A flare stack 76 is in fluid communication with the separator 70 via a vent gas line 78; the flare stack 76 includes an igniter 80. A vent gas analyzer and flow meter 82 is operably coupled to the vent gas line 78, the vent gas analyzer and flow meter 82 including, or being operably coupled to, a vent gas flow rate meter or sensor 84 and a hydrocarbon concentration sensor 86. Pressure sensors 88, 90, 92, 94, 96, and 98 are operably coupled to the fluid lines 56, 60, 64, 68, 72, and 74, respectively. A pressure sensor 100 is operably coupled to the vent gas line 78. A temperature sensor 102 is operably coupled to the fluid line 56. A level sensor 104 is operably coupled to the separator 70. The electronic controller 28 is in communication with the electric-actuated chokes 54 and 66, the pressure sensors 88, 90, 92, 94, 96, 98, and 100, the temperature sensor 102, and the level sensor 104; in several exemplary embodiments, the electronic controller 28 is housed within the control box 30 (not shown in FIG. 5). In several exemplary embodiments, each of the fluid lines 56, 60, 64, 68, 72, and 74 includes a plurality of fluid lines. In several exemplary embodiments, the vent gas line 78 includes a plurality of vent gas lines.

In an exemplary embodiment, each of the electric-actuated chokes 54 and 66 includes a valve and an electric actuator operably coupled thereto. In an exemplary embodiment, each of the electric-actuated chokes 54 and 66 includes the valve 14 and the electric actuator 16 operably coupled thereto. In several exemplary embodiments, in addition to the electric-actuated chokes 54 and 56, the system 52 includes one or more other electric-actuated chokes; in several exemplary embodiments, one or more of such one or more other electric-actuated chokes may be located downstream of, for example, the electric-actuated choke 54, the fixed choke 58, the fixed choke 62, the electric-actuated choke 66, or any combination thereof. In several exemplary embodiments, each of the electric-actuated chokes 54 and 56 is configured to provide the ability to effectively make flow area changes with greater sensitivity than 1/64-inch fixed orifice bean changes. In several exemplary embodiments, each of the electric-actuated chokes 54 and 56 is configured to control effective flow area to less than 0.005 square inch. In several exemplary embodiments, at least one of the electric-actuated choke 54 and the electric-actuated choke 66 is omitted from the system 52.

In several exemplary embodiments, each of the electric-actuated chokes 54 and 66 is, includes, or is part of, one or more exemplary embodiments of electric-actuated chokes described and/or illustrated in U.S. Application No. 62/180,735, filed Jun. 17, 2015, the entire disclosure of which is hereby incorporated herein by reference. In several exemplary embodiments, each of the electric-actuated chokes 54 and 66 is, includes, or is part of, one or more exemplary embodiments of electric-actuated chokes described and/or illustrated in U.S. Application No. 62/316,724, filed Apr. 1, 2016, the entire disclosure of which is hereby incorporated herein by reference.

In several exemplary embodiments, the electric-actuated choke 54 is omitted in favor of another type of actuated choke, such as a hydraulic-actuated choke, an electro-hydraulic actuated choke, an electric-over-hydraulic actuated choke, etc. In several exemplary embodiments, the electric-actuated choke 66 is omitted in favor of another type of actuated choke, such as a hydraulic-actuated choke, an electro-hydraulic actuated choke, an electric-over-hydraulic actuated choke, etc.

In several exemplary embodiments, each of the fixed chokes 58 and 62 is configured to effectively make flow area changes corresponding to, for example, 1/64-inch fixed orifice bean changes. In several exemplary embodiments, in addition to the fixed chokes 58 and 62, the system 52 includes one or more other fixed chokes; in several exemplary embodiments, one or more of such one or more other fixed chokes may be located downstream of, for example, the electric-actuated choke 54, the fixed choke 58, the fixed choke 62, the electric-actuated choke 66, or any combination thereof. In several exemplary embodiments, at least one of the fixed choke 58 and the fixed choke 62 is omitted from the system 52.

In an exemplary embodiment, the separator 70 is a three-phase separator configured to separate gas materials from fluid flow, and to separate other materials, such as oil and/or sand, from the fluid flow. In several exemplary embodiments, the separator 70 is, includes, or is part of, one or more three-phase separators, such as the one or more three-phase separators 20 (shown in FIGS. 1 and 4). In an exemplary embodiment, the separator 70 is a two-phase separator configured to separate gas materials from fluid flow so that liquid materials remain in the fluid flow, and/or slurry containing liquid materials and solid materials remains in the fluid flow; in an exemplary embodiment, the separator 70 is a two-phase separator, and the system 52 includes a sand separator positioned downstream of the wellhead 12 and upstream of the electric-actuated choke 54 (i.e., the sand separator is fluidically positioned between the wellhead 12 and the electric-actuated choke 54), and the sand separator is configured to separate sand and/or other solid materials from fluid flow before it flows into the electric-actuated choke 54. In several exemplary embodiments, in addition to the separator 70, the system 52 includes one or more other separators.

In several exemplary embodiments, the level sensor 104 is, includes, or is part of, the level sensor housing assembly 24. In several exemplary embodiments, the level sensor 104 is, includes, or is part of, the guided wave level sensor 26. In several exemplary embodiments, in addition to the pressure sensors 88, 90, 92, 94, 96, 98, and 100, the system 52 includes one or more additional pressure sensors, which may be distributed at different locations throughout the system 52. In several exemplary embodiments, in addition to the temperature sensor 102, the system 52 includes one or more additional temperature sensors, which may be distributed at different locations throughout the system 52. In several exemplary embodiments, in addition to the level sensor 104, the system 52 includes one or more additional level sensors, which may be distributed at different locations throughout the system 52 such as, for example, at the fluid reservoir 22, the separator 70, etc.; for example, as shown in FIG. 5, the guided wave level sensor 26 is operably coupled to the fluid reservoir 22.

In operation, in an exemplary embodiment, wellbore fluid flows out of the wellhead 12. In an exemplary embodiment, the wellbore fluid flow out of the wellhead 12 is part of a hydraulic fracturing operation; the wellbore fluid flow may be referred to as "frac flow-back" with the fluid itself being referred to as "flow-back." In an exemplary embodiment, the wellbore fluid flow out of the wellhead 12 is part of a well testing operation. In several exemplary embodiments, the wellbore fluid flow out of the wellhead 12 is part of another operation that is neither a hydraulic fracturing operation nor a well testing operation. In several exemplary embodiments, the wellbore fluid flowing out of the wellhead 12 is a multiphase flow. In several exemplary embodiments, the wellbore fluid flowing out of the wellhead 12 includes solid, liquid, and gas materials. In several exemplary embodiments, the wellbore fluid flowing out of the wellhead 12 includes water and/or other fluids having free gas therewithin, as well as sand and/or other solid materials. In several exemplary embodiments, the wellbore fluid flowing out of the wellhead 12 is a slurry that includes at least liquid and solid materials and, in several exemplary embodiments, gas materials.

The wellbore fluid flows from the wellhead 12 and to the electric-actuated choke 54 via at least the fluid line 56. The electric-actuated choke 54 controls a wellbore pressure, that is, the pressure of the wellbore of which the wellhead 12 is the surface termination. In several exemplary embodiments, the degree to which the electric-actuated choke 54 is open or closed controls the wellbore pressure.

The wellbore fluid flows through the electric-actuated choke 54 and to the fixed choke 58 via at least the fluid line 60. The wellbore fluid flows through the fixed choke 58, and to the fixed choke 62 via at least the fluid line 64. The wellbore fluid flows through the fixed choke 62 and into the fluid line 68. Each of the fixed chokes 58 and 62 provides a predetermined pressure drop thereacross, that is, a predetermined pressure differential. Therefore, as the wellbore fluid flows through the fixed choke 58, the wellbore fluid experiences a predetermined fixed pressure drop. Likewise, as the wellbore fluid flows through the fixed choke 62, the wellbore fluid experiences another predetermined fixed pressure drop. The flow of the wellbore fluid through the fixed chokes 58 and 62 results in the wellbore fluid experiencing multiple fixed pressure drops in stages, rather than a single larger pressure drop; this provides for better control velocity, better erosion control, better washout control, and better rupture prevention, of the components through which the wellbore fluid flows such as, for example, the fluid lines 56, 60, 64, 68, and 72, the electric-actuated chokes 54 and 66, the fixed chokes 58 and 62, other valves operably coupled to the fluid lines, other flow iron, fittings, and other components through which the wellbore fluid flows; this is especially helpful if the wellbore fluid flow contains abrasive materials.

The wellbore fluid flows from the fixed choke 62 and to the electric-actuated choke 66 via at least the fluid line 68. The electric-actuated choke 66 controls the flow velocity of the wellbore fluid (the flow back velocity). The wellbore fluid flows from the electric-actuated choke 66 and into the separator 70 via at least the fluid line 72. The separator 70 separates gas materials from the wellbore fluid flow; the gas materials flow out of the separator 70 via at least the gas vent line 78. In several exemplary embodiments, the separator 70 separates gas materials from the wellbore fluid flow, and also separates oil and/or sand from the wellbore fluid flow. In several exemplary embodiments, the separator 70 separates sand and/or other solid materials from the wellbore fluid flow.

The remaining liquid in the wellbore fluid and, in several exemplary embodiments, the remaining liquid and solid materials in the wellbore fluid, flow out of the separator 70 and into the fluid reservoir 22 via at least the fluid line 74. The liquid materials and, in several exemplary embodiments, the liquid and solid materials, collect within the fluid reservoir 22.

As noted above, the separated gas materials flow out of the separator 70 via at least the gas vent line 78. The gas materials flow through at least the gas vent line 78 and into the flare stack 76. The flare stack 76, which includes the igniter 80, operates to burn off the gas materials flowing into the flare stack 76. In an exemplary embodiment, as the gas materials flow through the gas vent line 78 and towards the flare stack 76, the vent gas analyzer and flow meter 82 measures the vent gas flow rate and the hydrocarbon concentration in the vent gas. In an exemplary embodiment, as the gas materials flow through the gas vent line 78 and towards the flare stack 76, the vent gas flow rate sensor 84 measures the vent gas flow rate, and the hydrocarbon concentration sensor 86 measures the hydrocarbon concentration in the vent gas.

During operation, in an exemplary embodiment, the pressure sensor 88 measures the wellbore pressure, that is, the pressure of the wellbore of which the wellhead 12 is the surface termination. The pressure sensors 90, 92, 94, 96, and 98 measure the respective pressures at the fluid lines 60, 64, 66, 68, 72, and 74, respectively. The pressure sensor 100 measures the pressure at the gas vent line 78. The temperature sensor 102 measures the wellbore temperature, that is, the temperature of the wellbore of which the wellhead 12 is the surface termination. The level sensor 104 measures the fluid level within the separator 70.

Each of the sensors 84, 86, 88, 90, 92, 94, 96, 98, 100, 102, and 104 communicates data associated with their aforementioned respective measurements to the electronic controller 28. The electronic controller 28 reads the data and, in turn, automatically controls the electric-actuated chokes 54 and 66, sending respective control outputs to the electric actuators of the electric-actuated chokes 54 and 66, which control outputs open the chokes 54 and/or 66, further open the chokes 54 and/or 66, further close the chokes 54 and/or 66, or maintain the open/closed positions of the chokes 54 and/or 66, based on the measurement data received from one or more, two or more, three or more, four or more, five or more, six or more, seven or more, eight or more, nine or more, ten or more, or all eleven, of the sensors 84, 86, 88, 90, 92, 94, 96, 98, 100, 102, and 104; thus, the electronic controller 28 automatically controls the electric-actuated chokes 54 and 66. The automatic control of the electric-actuated choke 54 by the electronic controller 28 automatically controls the wellbore pressure. The automatic control of the electric-actuated choke 66 by the electronic controller 28 automatically controls the flow velocity of the wellbore fluid (the flow back velocity).

As noted above, the automatic control of the electric-actuated choke 54 by the electronic controller 28 automatically controls the wellbore pressure. In several exemplary embodiments, the system 52, using at least the electric-actuated choke 54, actively controls the wellbore pressure to maintain the integrity of the wellbore of which the wellhead 12 is the surface termination. In several exemplary embodiments, the system 52, using at least the electric-actuated choke 54, actively controls the wellbore pressure to reduce the risk of the wellbore collapsing, and to reduce the risk of the wellbore clogging.

As noted above, the automatic control of the electric-actuated choke 66 by the electronic controller 28 automatically controls the flow velocity of the wellbore fluid (the flow back velocity). In several exemplary embodiments, the system 52, using at least the electric-actuated choke 66, actively controls the flow velocity of the wellbore fluid to prevent, or to at least minimize the risk of, erosion, washout, and/or rupture of the components through which the wellbore fluid flows such as, for example, the fluid lines 56, 60, 64, 68, and 72, the electric-actuated chokes 54 and 66, the fixed chokes 58 and 62, other valves operably coupled to the fluid lines, other flow iron, fittings, and other components through which the wellbore fluid flows; this is especially helpful if the wellbore fluid flow contains abrasive materials.

In several exemplary embodiments, during the operation of the system 52, the measurement data from the pressure sensors 88, 90, 92, 94, 96, 98, and 100 are analytically processed with other data for control algorithms for the electric-actuated chokes 54 and/or 66, and for predictive analytics related to erosion and plugging.

In several exemplary embodiments, during the operation of the system 52, the measurement data from the level sensor 104 are analytically processed with or without other data for control algorithms for the electric-actuated chokes 54 and/or 66.

In several exemplary embodiments, during operation, the electronic controller 28 controls both of the electric-actuated chokes 54 and 66, simultaneously or nearly simultaneously controlling wellbore pressure and flow back velocity.

In several exemplary embodiments, the electronic controller 28 automatically controls the electric-actuated chokes 54 and/or 66, in accordance with the foregoing, at least in part by: calculating the volume of fluid within the fluid reservoir 22; calculating a rate of change of the volume of fluid within the fluid reservoir 22; and, using the calculated volume of fluid within the fluid reservoir 22 and/or the calculated rate of change of the volume of fluid within the fluid reservoir 22, calculating the volumetric flow rate, the flow back velocity, and/or another operating parameter of the wellbore fluid flowing out of the wellhead 12. In an exemplary embodiment, to calculate the volume of fluid within the fluid reservoir 22, the electronic controller 28 uses a table and/or a predetermined mathematical function/equation, either or both of which is stored in a computer readable medium of the electronic controller 28 and/or another computer readable medium, to determine the volume based on the fluid level measurement made by the guided wave level sensor 26; in several exemplary embodiments, the table is a volume-vs.-fluid level linearization table the data points for which are based on, or supplied by, the vendor of the fluid reservoir 22; in several exemplary embodiments, the table itself is a list of level values correlated to respective volume values. In several exemplary embodiments, the predetermined mathematical function/equation is determined using data points from the linearization table; as a result, the predetermined mathematical function/equation yields an accurate volume calculation based on a fluid level measurement, regardless of whether that fluid level measurement is a data point based on, or supplied by, the vendor of the fluid reservoir 22 and/or whether that fluid level measurement is a data point in the table.

In an exemplary embodiment, the electronic controller 28 automatically controls the electric-actuated chokes 54 and/or 66, in accordance with the foregoing, using one or more continuous proportional-integral-derivative (PID) algorithms, each of the one or more PID algorithms having as its measured process variable at least one of the following: the rate of change of the fluid level within the fluid reservoir 22, which rate is based on the measurement data from the level sensor 104; the wellbore pressure based on the measurement data from the pressure sensor 88; the wellbore temperature based on the measurement data from the temperature sensor 102; one or more pressures based on the measurement data from one or more of the pressure sensors 88, 90, 92, 94, 96, 98, and 100; the vent gas flow rate based on the measurement data from the vent gas flow rate meter or sensor 84; and the hydrocarbon concentration in the vent gas based on the measurement data from the hydrocarbon concentration sensor 86; in several exemplary embodiments, these one or more continuous PID algorithms are, or are part of, a computer program stored in the electronic controller 28, which executes the computer program during the above-described operation of the system 52.

In an exemplary embodiment, the electronic controller 28 automatically controls the electric-actuated chokes 54 and/or 66, in accordance with the foregoing, using one or more discrete PID algorithms, each of the one or more PID algorithms having as its measured process variable at least one of the following: the rate of change of the fluid level within the fluid reservoir 22, which rate is based on the measurement data from the level sensor 104; the wellbore pressure based on the measurement data from the pressure sensor 88; the wellbore temperature based on the measurement data from the temperature sensor 102; one or more pressures based on the measurement data from one or more of the pressure sensors 88, 90, 92, 94, 96, 98, and 100; the vent gas flow rate based on the measurement data from the vent gas flow rate meter or sensor 84; and the hydrocarbon concentration in the vent gas based on the measurement data from the hydrocarbon concentration sensor 86; in several exemplary embodiments, these one or more discrete PID algorithms are, or are part of, a computer program stored in the electronic controller 28, which executes the computer program during the above-described operation of the system 52.

In several exemplary embodiments, the combination of the sensors 84, 86, 88, 90, 92, 94, 96, 98, 100, 102, and 104, the electronic controller 28, and the electric-actuated chokes 54 and 66 actively controls wellbore surface pressure and flow-back volumetric flow rates; that is, the combination actively controls the surface pressure of the wellbore of which the wellhead 12 is the surface termination, as well as the volumetric flow rate of the wellbore fluid flowing out of the wellhead 12. In several exemplary embodiments, the system 52 provides real-time level change analysis and communication for monitoring, decision making, and intelligent control. In several exemplary embodiments, the level sensor 104 provides level and flow rate data. In several exemplary embodiments, the electronic controller 28 provides local data storage thereon, and/or includes a web-enabled data portal. In several exemplary embodiments, the electronic controller 28 is in communication with, via a network, one or more computing devices, each of which is located either at the site where the wellhead 12 is located or at a remote location such as, for example, a centralized operation system; via the network, the electronic controller 28 transmits data (e.g., volumetric flow rate data, fluid level data, fluid volume data, rate of change of fluid volume data, etc.) to the one or more computing devices. In several exemplary embodiments, the system 52 provides intelligent alarms with respect to volumetric flow rate of the wellbore fluid flowing from the wellhead 12, actual flow rate versus target flow rate, flow rate versus choke position, other logic and relationship-based alarms, or any combination thereof.

In several exemplary embodiments, the system 52 intelligently controls wellbore flow during frac flow-back and well testing operations. In several exemplary embodiments, the system 52 enables the customization of a targeted flow-back profile, while maintaining a predetermined volumetric flow rate over specific time periods such as, for example, every hour, every 30 minutes, every few minutes, etc. In several exemplary embodiments, the system 52 enables the customization of a targeted flow-back profile, while maintaining a predetermined volumetric flow rate within a predetermined percentage such as, for example, +/−10%, over specific time periods such as, for example, every hour, every 30 minutes, every few minutes, etc.

In several exemplary embodiments, the system 52 provides precision flow control, providing the ability to adjust effective flow area with greater sensitivity than incremental fixed orifices, or "beans," which may be positioned upstream of the fluid reservoir 22 to control the volumetric flow rate of the wellbore fluid from the wellhead 12 to the fluid reservoir 22. In several exemplary embodiments, either of the electric-actuated chokes 54 and 66, and the automatic control thereof, provide the ability to effectively make flow area changes with greater sensitivity than 1/64-inch fixed orifice bean changes. In several exemplary embodiments, the characterization of either of the electric-actuated chokes 54 and 66 provides flow rate versus choke position, including $64^{th}$ orifice equivalents. In several exemplary embodiments, either of the electric-actuated chokes 54 and 66, and the automatic control thereof, provide the ability to control effective flow area to less than 0.005 square inch, which is less than a $1/64^{th}$-inch (0.016-inch) fixed orifice bean change.

In several exemplary embodiments, using the system 52, the flow coefficient Cv of the flow-back can be controlled within a predetermined percentage such as, for example, +/−5%. In several exemplary embodiments, using the system 52, the response time for incremental adjustments is less than 0.05 inch per second. In several exemplary embodiments, the electronic controller 28 is programmed for greater speed control.

In several exemplary embodiments, the system 52 provides precise flow control, which allows for tighter flow control "windows" such as, for example, a flow-back volumetric flow rate window that ranges from a predetermined minimum volumetric flow rate to a predetermined maximum volumetric flow rate.

In several exemplary embodiments, the above-described data communication between the electronic controller 28 and one or more computing devices allows for trend analysis and the development of operational standards.

In several exemplary embodiments, the system 52 provides active monitoring and management of well completions, positively impacting overall wellbore integrity and ultimately enhancing oil and/or gas production out of the wellbore. In several exemplary embodiments, the system 52 may be configured to enhance wellbore production by maximizing initial oil and/or gas production, total oil and/or gas production, or a combination of initial oil and/or gas production and total oil and/or gas production.

In several exemplary embodiments, the system 52 includes one or more flow meters respectively operably coupled to one or more of the fluid lines 56, 60, 64, 68, and 72 to measure the volumetric flow rate and/or flow back velocity of the wellbore fluid flowing out of the wellhead 12; in several exemplary embodiments, such flow meter(s) are in communication with the electronic controller 28, which uses data received from such flow meter(s) to control the wellbore fluid flowing out of the wellhead 12.

Figure 6:
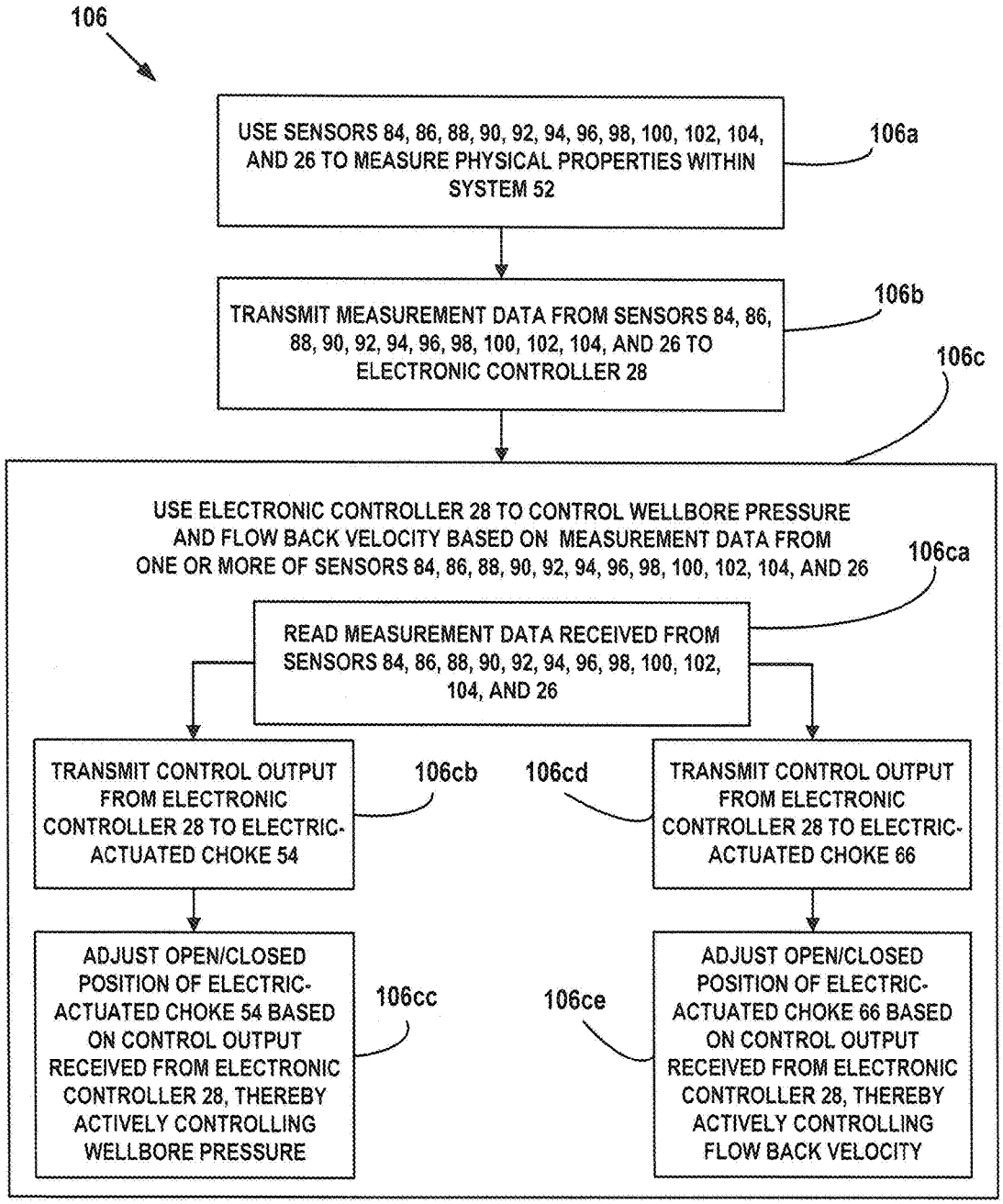
FIG. 6 is a flow chart illustration of a method executed using the system of FIG. 5, according to an exemplary embodiment.

In an exemplary embodiment, as illustrated in FIG. 6 with continuing reference to FIGS. 1-5, a method is generally referred to by the reference numeral 106. The method 106 is a method of actively controlling a plurality of operating parameters associated with a wellbore fluid flowing out of a wellhead and through at least two electric-actuated chokes. In several exemplary embodiments, the method 106 is executed using in whole or in part the system 52 of FIG. 5, with the wellbore fluid flowing out of the wellhead 12 and through the electric-actuated chokes 54 and 66.

As shown in FIG. 6, the method 106 includes a step 106*a*, at which the sensors 84, 86, 88, 90, 92, 94, 96, 98, 100, 102, and 104 are used to measure the different physical properties within the system 52, in accordance with the foregoing. At step 106*b*, measurement data is transmitted from the sensors 84, 86, 88, 90, 92, 94, 96, 98, 100, 102, and 104 to the electronic controller 28, the measurement data being associated with the respective measurements of the physical properties at the step 106*a*. In several exemplary embodiments, the measurement data transmitted at the step 106*b* is transmitted in whole or in part serially, in whole or in part simultaneously, in whole or in part a combination of serially and simultaneously, or in any combination thereof. At step 106*c*, the electronic controller 28 is used to control the wellbore pressure and flow back velocity based in whole or in part on the measurement data received at the step 106*b*.

In an exemplary embodiment, as shown in FIG. 6, the step 106*c* includes a step 106*ca*, at which the electronic controller 28 is used to read the measurement data received at the step 106*b*. At step 106*cb*, a control output is transmitted from the electronic controller 28 to the electric-actuated choke 54, the control output being based in whole or in part on the measurement data received at the step 106*b*. In several exemplary embodiments, the electronic controller 28 analyzes and/or processes in whole or in part the measurement data received at the step 106*b* to determine the control output to be transmitted at the step 106*cb*. In an exemplary embodiment, the control output transmitted at the step 106*cb* includes one or more electrical control signals, which are received by the electric-actuated choke 54.

At step 106*cc*, the open/closed position of the electric-actuated choke 54 is adjusted based on the control output transmitted at the step 106*cb*; as a result, the wellbore pressure is actively controlled. In several exemplary embodiments, the step 106*cc* is omitted if the electronic controller 28 determines that no adjustments to the wellbore pressure are necessary and thus determines that the current open/closed position of the electric-actuated choke 54 should be maintained. In several exemplary embodiments, the steps 106*cb* and 106*cc* are omitted if the electronic controller 28 determines that no adjustments to the wellbore pressure are necessary, and thus determines that the current open/closed position of the electric-actuated choke 54 should be maintained.

Before, during, or after the steps 106*cb* and/or 106*cc*, at step 106*cd*, a control output is transmitted from the electronic controller 28 to the electric-actuated choke 66, the control output being based in whole or in part on the measurement data received at the step 106*b*. In several exemplary embodiments, the electronic controller 28 analyzes and/or processes in whole or in part the measurement data received at the step 106*b* to determine the control output to be transmitted at the step 106*cd*. In an exemplary embodiment, the control output transmitted at the step 106*cd* includes one or more electrical control signals, which are received by the electric-actuated choke 66.

Before, during, or after the steps 106*cb* and/or 106*cc*, at step 106*ce*, the open/closed position of the electric-actuated choke 66 is adjusted based on the control output transmitted at the step 106*cd*; as a result, the flow back velocity is actively controlled. In several exemplary embodiments, the step 106*cd* is omitted if the electronic controller 28 determines that no adjustments to the flow back velocity are necessary and thus determines that the current open/closed position of the electric-actuated choke 66 should be maintained. In several exemplary embodiments, the steps 106*cd* and 106*ce* are omitted if the electronic controller 28 determines that no adjustments to the flow back velocity are necessary, and thus determines that the current open/closed position of the electric-actuated choke 66 should be maintained.

In several exemplary embodiments, during the execution of the method 106, the electronic controller 28 controls both of the electric-actuated chokes 54 and 66, simultaneously or nearly simultaneously controlling wellbore pressure and flow back velocity.

In several exemplary embodiments, at the step 106*c*, the electronic controller 28 automatically controls the electric-actuated chokes 54 and 66, in accordance with the foregoing, using one or more continuous proportional-integral-derivative (PID) algorithms, each of the one or more PID algorithms having as its measured process variable at least one of the following: the rate of change of the fluid level within the fluid reservoir 22, which rate is based on the measurement data from the level sensor 104; the wellbore pressure based on the measurement data from the pressure sensor 88; the wellbore temperature based on the measurement data from the temperature sensor 102; one or more pressures based on the measurement data from one or more of the pressure sensors 88, 90, 92, 94, 96, 98, and 100; the vent gas flow rate based on the measurement data from the vent gas flow rate meter or sensor 84; and the hydrocarbon concentration in the vent gas based on the measurement data from the hydrocarbon concentration sensor 86; in several exemplary embodiments, these one or more continuous PID algorithms are, or are part of, a computer program stored in the electronic controller 28, which executes the computer program during the execution of the method 106. In several exemplary embodiments, at the step 106*c*, the electronic controller 28 automatically controls the electric-actuated chokes 54 and 66, in accordance with the foregoing, using one or more discrete proportional-integral-derivative (PID) algorithms, each of the one or more PID algorithms having as its measured process variable at least one of the following: the rate of change of the fluid level within the fluid reservoir 22, which rate is based on the measurement data from the level sensor 104; the wellbore pressure based on the measurement data from the pressure sensor 88; the wellbore temperature based on the measurement data from the temperature sensor 102; one or more pressures based on the measurement data from one or more of the pressure sensors 88, 90, 92, 94, 96, 98, and 100; the vent gas flow rate based on the measurement data from the vent gas flow rate meter or sensor 84; and the hydrocarbon concentration in the vent gas based on the measurement data from the hydrocarbon concentration sensor 86; in several exemplary embodiments, these one or more discrete PID algorithms are, or are part of, a computer program stored in the electronic controller 28, which executes the computer program during the execution of the method 106.

Figure 7:
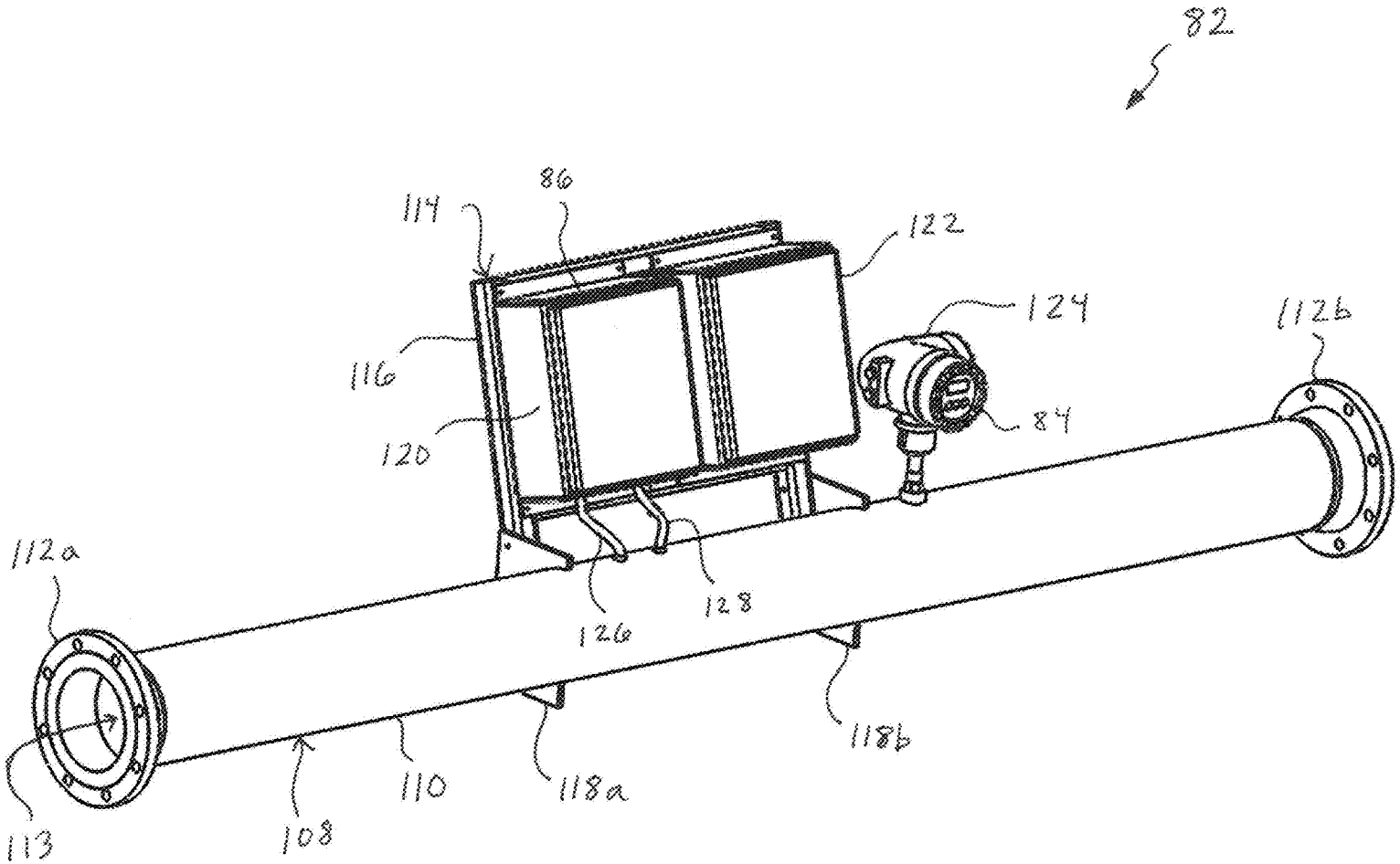
FIG. 7 is a perspective view of the vent gas analyzer and flow meter of the system of FIG. 5, according to an exemplary embodiment.
Figure 8:
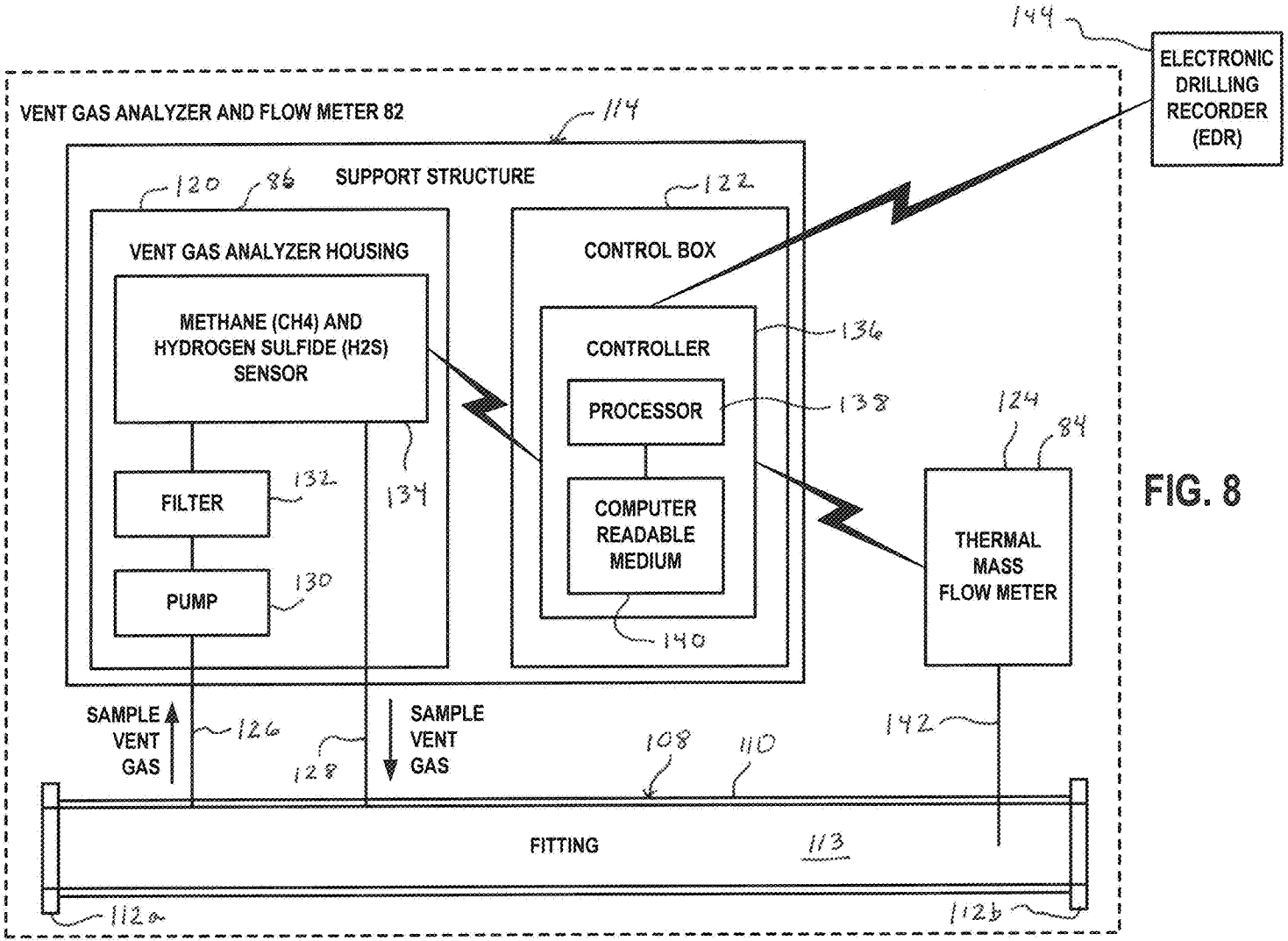
FIG. 8 is a diagrammatic illustration of an electronic drilling recorder (EDR) and the vent gas analyzer and flow meter of FIG. 7, according to an exemplary embodiment.

In an exemplary embodiment, as illustrated in FIGS. 7 and 8 with continuing reference to FIGS. 1-6, the vent gas analyzer and flow meter 82 includes a fitting 108, which includes a tubular member 110 and respective flanges 112*a* and 112*b* connected to opposing end portions of the tubular member 110. The tubular member 110 defines an internal fluid passage 113. In an exemplary embodiment, when the vent gas analyzer 82 is operably coupled to the gas vent line 78, the fitting 108 forms part of the vent gas line 78, with the fitting 108 being connected in an in-line configuration with the remainder of the vent gas line 78. A support structure 114 is connected to the tubular member 110. The support structure 114 includes a frame 116 and parallel-spaced brackets 118*a* and 118*b* connected thereto. The parallel-spaced brackets 118*a* and 118*b* are connected to the tubular member 110, thereby connecting, at least in part, the support structure 114 to the tubular member 110. A vent gas analyzer housing 120 is connected to the frame 116. A control box 122 is connected to the frame 116. A thermal mass flow meter 124 is connected to the tubular member 110. A sample vent gas inlet line 126 is connected to the tubular member 110, and extends between the tubular member 110 and the vent gas analyzer housing 120. Likewise, a sample vent gas outlet line 128 is connected to the tubular member 110, and extends between the tubular member 110 and the vent gas analyzer housing 120.

As shown in FIG. 8, a pump 130, a filter 132, and a methane (CH4) and hydrogen sulfide (H2S) sensor 134 are housed within the vent gas analyzer housing 120. The pump 130 is in fluid communication with the internal fluid passage 113 via at least the sample vent gas inlet line 126, a portion of which extends from the tubular member 110, into the vent gas analyzer housing 120, and to the pump 130. The filter 132 is in fluid communication with the pump 130 via at least the sample vent gas inlet line 126. The methane and hydrogen sulfide sensor 134 is in fluid communication with the filter 132 via at least the sample vent gas inlet line 126. Thus, the methane and hydrogen sulfide sensor 134 is in fluid communication with the internal fluid passage 113 via at least the sample vent gas inlet line 126. In several exemplary embodiments, the sample vent gas inlet line 126 includes a plurality of lines such as tubular members, hoses, etc., which extend between various components such as, for example, the pump 130, the filter 132, and the methane and hydrogen sulfide sensor 134. In an exemplary embodiment, the filter 132 is located outside of the vent gas analyzer housing 120, and is fluidically positioned between the internal fluid passage 113 and the pump 130, rather than being located within the vent gas analyzer housing 120 and fluidically positioned between the pump 130 and the methane and hydrogen sulfide sensor 134. The methane and hydrogen sulfide sensor 134 is also in fluid communication with the internal fluid passage 113 via the sample vent gas outlet line 128, which extends from the methane and hydrogen sulfide sensor 134, out of the vent gas analyzer housing 120, and to the tubular member 110. In several exemplary embodiments, the sample vent gas outlet line 128 includes a plurality of lines such as tubular members, hoses, etc., which extend between various components located within, and/or outside of, the vent gas analyzer housing 120.

In several exemplary embodiments, the methane and hydrogen sulfide sensor 134 is configured to measure methane concentration (0-100 volume percentage), and is configured to measure hydrogen sulfide concentration (0-100 ppm).

In several exemplary embodiments, one or more of the vent gas analyzer housing 120, the pump 130, the filter 132, and the methane and hydrogen sulfide sensor 134 are part of a 35-3001 Series Sample Draw Sensor/Transmitter, which is available from RKI Instruments, Inc., Union City, Calif. USA.

With continuing reference to FIG. 8, a controller 136 is housed within the control box 122. The controller 136 includes a processor 138 and a non-transitory computer readable medium 140 operably coupled thereto; a plurality of instructions are stored on the non-transitory computer readable medium 140, the instructions being accessible to, and executable by, the processor 138. The controller 136 is configured to store data on the computer readable medium 130. The thermal mass flow meter 124 includes a probe 142, which extends into the internal fluid passage 113. In several exemplary embodiments, the thermal mass flow meter 124 is specially constructed for wet gas environments. In several exemplary embodiments, the thermal mass flow meter 124 is a Series 454FTB single-point insertion flow meter, which is available from Kurz Instruments, Inc., Monterey, Calif. USA.

The controller 136 is in communication with each of the methane and hydrogen sulfide sensor 134 and the thermal mass flow meter 124. In several exemplary embodiments, the controller 136 is configured to receive data from each of the methane and hydrogen sulfide sensor 134 and the thermal mass flow meter 124. The controller 136 is configured to receive data from each of the methane and hydrogen sulfide sensor 134 and the thermal mass flow meter 124, and to calculate the cumulative volume of methane vented via the gas vent line 78; based at least in part on this calculation, the methane concentration in the gas materials being vented via the gas vent line 78 is determined.

In an exemplary embodiment, as indicated in FIGS. 7 and 8, the vent gas flow rate sensor 84 is the thermal mass flow meter 124.

In an exemplary embodiment, as indicated in FIGS. 7 and 8, the hydrocarbon concentration sensor 86 includes at least the vent gas analyzer housing 120 and the methane and hydrogen sulfide sensor 134 housed therein. In several exemplary embodiments, the hydrocarbon sensor 86 includes at least the vent gas analyzer housing 120 and all components housed therein, including the methane and hydrogen sulfide sensor 134. In several exemplary embodiments, the hydrocarbon sensor 86 includes at least the methane and hydrogen sulfide sensor 134.

In an exemplary embodiment, as shown in FIG. 8, an electronic drilling recorder (EDR) 144 is communication with the controller 136 of the vent gas analyzer and flow meter 82. The EDR 144 is located at a drilling rig site used in oil and gas exploration and production operations.

During the operation of the system 52, in an exemplary embodiment and as described above, the gas materials separated by the separator 70 via at least the gas vent line 78. The gas materials flow through at least the gas vent line 78 and into the flare stack 76. The flare stack 76, which includes the igniter 80, operates to burn off the gas materials flowing into the flare stack 76. In an exemplary embodiment, as the gas materials flow through the gas vent line 78 and towards the flare stack 76, the vent gas analyzer and flow meter 82 measures the vent gas flow rate and the hydrocarbon concentration in the vent gas. In an exemplary embodiment, as the gas materials flow through the gas vent line 78 and towards the flare stack 76, the vent gas flow rate sensor 84 measures the vent gas flow rate, and the hydrocarbon concentration sensor 86 measures the hydrocarbon concentration in the vent gas.

With continuing reference to FIGS. 7 and 8, in an exemplary embodiment, the gas materials separated by the separator 70 flow through the gas vent line 78 and thus flow through the internal fluid passage 113 of the tubular member 110 of the vent gas analyzer and flow meter 82. During the flow of the gas materials, the pump 130 sucks a portion of the gas materials ("sample gas materials") out of the internal fluid passage 113 and through the sample vent gas inlet line 126. The pump 130 causes the sample gas materials to flow through the filter 132, which filters the sample gas materials. The pump 130 causes the sample gas materials to flow through the methane and hydrogen sulfide sensor 134, which measures the methane concentration (0-100 volume percentage) in the sample gas materials, and which also measures the hydrogen sulfide concentration (0-100 ppm) in the sample gas materials. The pump 130 pumps the sample gas materials from the methane and hydrogen sulfide sensor 134, through the sample vent gas outlet line 128, and back into the internal fluid passage 113. The sample gas materials then flow with the vent gas flow in the gas vent line 78 to the flare stack 76, wherein the igniter 80 operates to burn off the gas materials in the vent gas flow, which gas materials include the sample gas materials.

As the gas materials flow through the internal fluid passage 113 and past the probe 142, the thermal mass flow meter 124 uses the probe 142 thereof to measure the vent gas flow rate. In several exemplary embodiments, the thermal mass flow meter 124 is able to measure the vent gas flow rate over a range of 0 to 2,000 surface feet per minute (SFPM) (9.3 normal meters per second (NMPS)) (CH4), with a velocity accuracy of +/−(1% of reading+20 SFPM).

The methane and hydrogen sulfide sensor 134 transmits to the controller 136 measurement data associated with the methane concentration measurement, as well as measurement data associated with the hydrogen sulfide concentration. The thermal mass flow meter 124 transmits to the controller 136 measurement data associated with the vent gas flow rate measurement. Using the measurement data received from each of the methane and hydrogen sulfide sensor 134 and the thermal mass flow meter 124, the controller 136 determines one or more operating parameters including, in several exemplary embodiments, the cumulative volume of methane vented. In several exemplary embodiments, the controller 136 stores on the computer readable medium 140 measurement data received from the methane and hydrogen sulfide sensor 134 and the thermal mass flow meter 124.

During the above-described operation of the vent gas analyzer and flow meter 82 of FIG. 8, the controller 136 sends or transmits to the EDR 144 parameter data associated with the determined one or more operating parameters including, in several exemplary embodiments, the cumulative volume of methane vented. Thus, the one or more operating parameters of the vent gas line 78 are remotely monitored, using the EDR 144, from a central location at the rig site. In an exemplary embodiment, the parameter data sent by the controller 136 to the EDR 144 includes parameter data indicative of an alarm to trigger operators of the EDR 144, notifying the operators of an unwanted condition with respect to the vent gas line 78. In an exemplary embodiment, the controller 136 is in communication with the EDR 144 via Wellsite Information Transfer Specification (WITS) protocol, enabling remote monitoring and alarm settings.

In several exemplary embodiments, when the system 52 includes the exemplary embodiment of the vent gas analyzer and flow meter 82 illustrated in FIG. 8, the controller 136 sends or transmits measurement data and/or parameter data to the electronic controller 28 which, in several exemplary embodiments, controls the electric-actuated chokes 54 and/or 66 based on the measurement data in whole or in part, and/or based on the parameter data in whole or in part.

In several exemplary embodiments, when the system 52 includes the exemplary embodiment of the vent gas analyzer and flow meter 82 illustrated in FIG. 8, the thermal mass flow meter 124 sends or transmits measurement data and/or parameter data to the electronic controller 28 which, in several exemplary embodiments, controls the electric-actuated chokes 54 and/or 66 based on the measurement data in whole or in part, and/or based on the parameter data in whole or in part.

As a result of the above-described operation of the vent gas analyzer and flow meter 82 of FIG. 8, in several exemplary embodiments, the relative concentrations of production gas (i.e., hydrocarbon gas such as, or including, for example, methane gas) and gas used in hydraulic fracturing operations (e.g., carbon dioxide gas) is able to be remotely monitored at, for example, a drilling rig site used in oil and gas exploration and production operations, a remotely-located central location monitoring a plurality of drilling rig sites, a remotely-located maintenance and engineering center, or any combination thereof.

In several exemplary embodiments, in addition to the vent gas analyzer and flow meter 82, the system 52 includes a plurality of vent gas analyzers and flow meters, each of which is substantially identical to the vent gas analyzer and flow meter 82.

Figure 9:
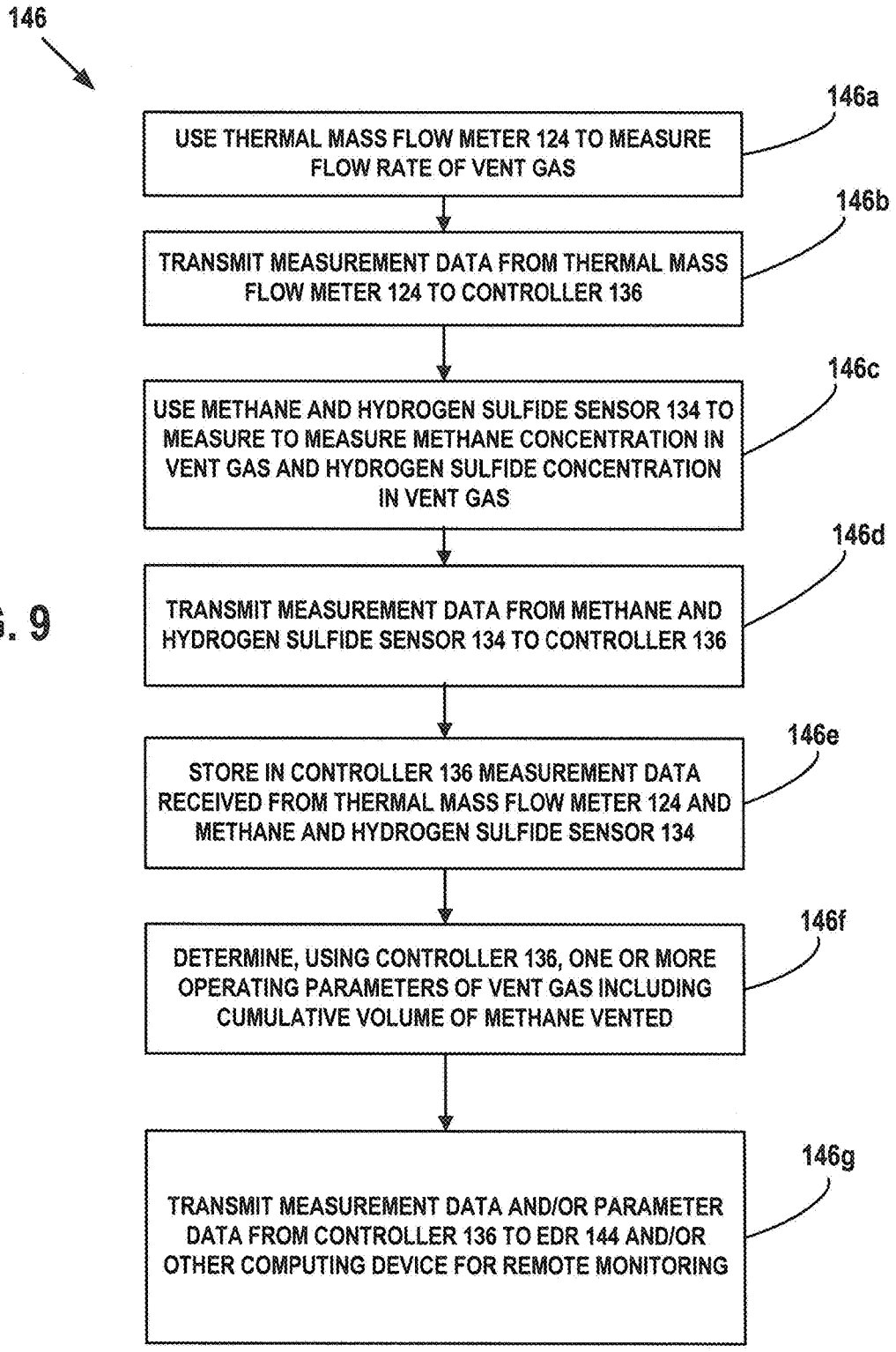
FIG. 9 is a flow chart illustration of a method of executed using the exemplary embodiment of the vent gas analyzer and flow meter of FIGS. 7 and 8, according to an exemplary embodiment.

In an exemplary embodiment, as illustrated in FIG. 9 with continuing reference to FIGS. 1-8, a method is generally referred to by the reference numeral 146. The method 146 is a method of remotely monitoring vent gas separated from a wellbore fluid flowing out of a wellhead. In several exemplary embodiments, the method 146 is executed in whole or in part using the system 52. In several exemplary embodiments, the method 146 is executed in whole or in part using the embodiment of the vent gas analyzer flow meter 82 illustrated in FIG. 5. In several exemplary embodiments, the method 146 is executed in whole or in part using the exemplary embodiment of the vent gas analyzer flow meter 82 illustrated in FIGS. 7 and 8. In several exemplary embodiments, the method 146 is executed in whole or in part using the exemplary embodiment(s) illustrated in FIGS. 7 and 8.

As shown in FIG. 9, the method 146 includes a step 146*a* at which the thermal mass flow meter 124 is used to measure the flow rate of the vent gas separated by the separator 70 and flowing through the vent gas line 78 and to the flare stack 76. At step 146*b* measurement data is transmitted from the thermal mass flow meter 124 to the controller 136, the measurement data being associated with the flow rate measured at the step 146*a*. At step 146*c* the methane and hydrogen sulfide sensor 134 is used to measure the methane concentration in the vent gas, as well as the hydrogen sulfide concentration in the vent gas. At step 146*d* measurement data is transmitted from the methane and hydrogen sulfide sensor 134 to the controller 136, the measurement data being associated with the methane concentration measured at the step 146*c*, as well as the hydrogen sulfide concentration measured at the step 146*c*. At step 146*e* the measurement data received from the thermal mass flow meter 124 and the methane and hydrogen sulfide sensor 134 are stored in the controller 136. At step 146*f* one or more operating parameters of the vent gas are calculated or determined using the controller 136, the one or more operating parameters including the cumulative volume of methane vented. At step 146*g* the measurement data received from the thermal mass flow meter 124 and the methane and hydrogen sulfide sensor 134, and/or parameter data associated with the one or more operating parameters determined at the step 146*f*, are transmitted from the controller 136 to the EDR 144 and/or to another computing device for remote monitoring; in several exemplary embodiments, the another computer device includes the electronic controller 28, another electronic controller, a remote-located computer or server, etc.

As a result of the execution of the method 146, in several exemplary embodiments, the relative concentrations of production gas (i.e., hydrocarbon gas such as, or including, for example, methane gas) and gas used in hydraulic fracturing operations (e.g., carbon dioxide gas) is able to be remotely monitored at, for example, a drilling rig site used in oil and gas exploration and production operations, a remotely-located central location monitoring a plurality of drilling rig sites, a remotely-located maintenance and engineering center, or any combination thereof.

In several exemplary embodiments, one or more of the steps 146*a*-146*g* are omitted from the method 146.

Figure 10:
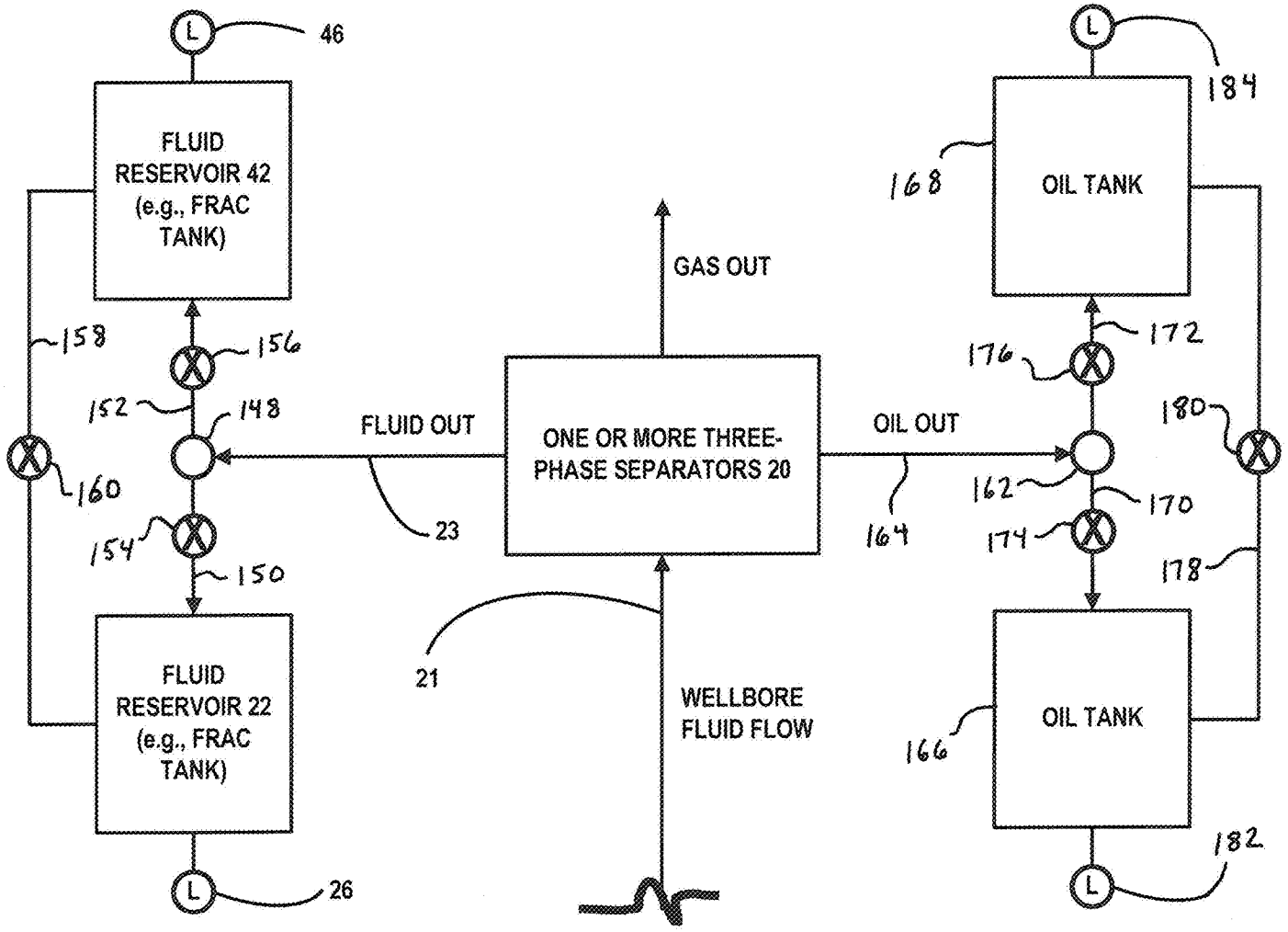
FIG. 10 is a diagrammatic illustration of a modification to the system of FIG. 4, according to an exemplary embodiment.

In an exemplary embodiment, as illustrated in FIG. 10 with continuing reference to FIG. 4, as well as to FIGS. 1-3 and 5-9, the fluid line 43 may be omitted from the system 40 of FIG. 4; instead, in the system 40, the fluid line 23 is in fluid communication with a header 148, as shown in FIG. 10. The fluid reservoirs 22 and 42 are in fluid communication with the header 148 via fluid lines 150 and 152, respectively. The fluid lines 150 and 152 include valves 154 and 156, respectively. A fluid line 158 extends between the fluid reservoirs 22 and 42, and includes a valve 160. A header 162 is in fluid communication with the one or more three-phase separators 20 via a fluid line 164. Fluid reservoirs, such as oil tanks 166 and 168, are in fluid communication with the header 162 via fluid lines 170 and 172, respectively. The fluid lines 170 and 172 include valves 174 and 176, respectively. A fluid line 178 extends between the oil tanks 166 and 168, and includes a valve 180. Level sensors 182 and 184 are operably coupled to the oil tanks 166 and 168, respectively. In several exemplary embodiments, the level sensors 182 and 184 are substantially identical to the level sensors 26 and 46, which are operably coupled to the fluid reservoirs 22 and 42, respectively; as a result, in several exemplary embodiments, each of the level sensors 182 and 184 is housed within a level sensor housing assembly, which is substantially identical to the level sensor housing assembly 24 or 44.

In an exemplary embodiment, the operation of the system 40, as illustrated in FIG. 4 with the above-described modifications of the system 40 illustrated in FIG. 10, is substantially identical to the operation of the system 40 described above with reference to FIG. 4, except that fluid flowing out of the one or more three-phase separators 20, via the fluid line 23, flows to the header 148, which splits the fluid flow between the fluid line 150 and the fluid line 152. As a result, fluid flowing out of the one or more three-phase separators 20 and via the fluid line 23 is split, with a portion of the fluid flowing into the fluid reservoir 22 via the header 148 and the fluid line 150, and the remaining portion of the fluid flowing into the fluid reservoir 42 via the header 148 and the fluid line 150; the fluid collects within the fluid reservoirs 22 and 42. In several exemplary embodiments, the fluid flowing out of the one or more three-phase separators 20, via the fluid line 23, is, or includes, water, mud, a slurry, other liquid materials, other solid materials, or any combination thereof.

During the collection of fluid within the fluid reservoirs 22 and 24, in an exemplary embodiment, the level sensors 26 and 46 measure the respective fluid levels in the fluid reservoirs 22 and 24, and communicate data associated with the measurements to the electronic controller 28. In addition to controlling the electric actuator 16 based on the measurement data received from the level sensors 26 and 46, the electronic controller 28 controls the valve 160 based on the measurement data received from the level sensors 26 and 46, thereby actively controlling the relationship between the respective fluid levels within the fluid reservoirs 22 and 24.

This actively controlled relationship may be a balanced (substantially equal) relationship, or it may be in accordance with some other relationship, such as the fluid reservoir 22 having a fluid level target that is less than, or greater than, the fluid level target within the fluid level reservoir 42, or vice versa.

For example, based on measurements by the level sensor 26, if the electronic controller 28 determines that the fluid level within the fluid reservoir 22 is either too high or rising too quickly within the fluid reservoir 22, and the fluid level, as measured by the level sensor 46, is not as high within the fluid reservoir 42, the electronic controller 28 causes the valve 160 to open or further open, allowing fluid to flow from the fluid reservoir 22 to the fluid reservoir 42; as a result, the fluid levels across the fluid reservoirs 22 and 42 are actively controlled. Conversely, based on measurements by the level sensor 46, if the electronic controller 28 determines that the fluid level within the fluid reservoir 42 is either too high or rising too quickly within the fluid reservoir 42, and the fluid level, as measured by the level sensor 26, is not as high within the fluid reservoir 22, the electronic controller 28 causes the valve 160 to open or further open, allowing fluid to flow from the fluid reservoir 42 to the fluid reservoir 22; as a result, the relationship between the respective fluid levels within the fluid reservoirs 22 and 42 is actively controlled. Additionally, in several exemplary embodiments, the electronic controller 28 also controls the valves 154 and/or 156, to facilitate the active control of the relationship between the respective fluid levels within the fluid reservoirs 22 and 42. In several exemplary embodiments, the use of measurement data from each of the guided wave level sensors 26 and 46 increases the degree to which the respective fluid levels within the fluid reservoirs 22 and 42 are precisely controlled.

In an exemplary embodiment, during the operation of the system 40, the valve 156 is initially closed and the valve 154 is initially open, and all fluid flowing out of the one or more three-phase separators 20, via the fluid line 23, at least initially flows into the fluid reservoir 22 via the header 148 and the fluid line 150. If the fluid level within the fluid reservoir 22 becomes too high, the electronic controller 28 causes the valve 160 to open or further open, allowing fluid to flow from the fluid reservoir 22 to the fluid reservoir 42; as a result, the relationship between the respective fluid levels within the fluid reservoirs 22 and 42 is actively controlled.

In an exemplary embodiment, during the operation of the system 40, the valve 154 is initially closed and the valve 156 is initially open, and all fluid flowing out of the one or more three-phase separators 20, via the fluid line 23, at least initially flows into the fluid reservoir 42 via the header 148 and the fluid line 152. If the fluid level within the fluid reservoir 42 becomes too high, the electronic controller 28 causes the valve 160 to open or further open, allowing fluid to flow from the fluid reservoir 42 to the fluid reservoir 22; as a result, the relationship between the respective fluid levels within the fluid reservoirs 22 and 42 is actively controlled.

Additionally, during the operation of the system 40, as illustrated in FIG. 4 with the above-described modifications of the system 40 illustrated in FIG. 10, oil flows out of the one or more three-phase separators 20, via the fluid line 164, and flows to the header 162, which splits the oil flow between the fluid line 170 and the fluid line 172. As a result, oil flowing out of the one or more three-phase separators 20 and via the fluid line 164 is split, with a portion of the oil flowing into the oil tank 166 via the header 162 and the fluid line 170, and the remaining portion of the oil flowing into the oil tank 168 via the header 162 and the fluid line 172; the oil collects within the oil tanks 166 and 168.

During the collection of oil within the oil tanks 166 and 168, in an exemplary embodiment, the level sensors 182 and 184 measure the respective oil levels in the oil tanks 166 and 168, and communicate data associated with the measurements to the electronic controller 28. In addition to controlling the electric actuator 16, the valve 160, the valve 154, the valve 156, or any combination thereof based on the measurement data received from the level sensors 26 and 46, the electronic controller 28 controls the valve 180 based on the measurement data received from the level sensors 182 and 184, thereby actively controlling the respective oil levels within the oil tanks 166 and 168. This actively controlled relationship may be a balanced (substantially equal) relationship, or it may be in accordance with some other relationship, such as the oil tank 166 having an oil level target that is less than, or greater than, the oil level target within the oil tank 168, or vice versa.

For example, based on measurements by the level sensor 182, if the electronic controller 28 determines that the oil level within the oil tank 166 is either too high or rising too quickly within the oil tank 166, and the oil level, as measured by the level sensor 184, is not as high within the oil tank 168, the electronic controller 28 causes the valve 180 to open or further open, allowing oil to flow from the oil tank 166 to the oil tank 168; as a result, the relationship between the respective oil levels within the oil tanks 166 and 168 is actively controlled. Conversely, based on measurements by the level sensor 184, if the electronic controller 28 determines that the oil level within the oil tank 168 is either too high or rising too quickly within the oil tank 168, and the oil level, as measured by the level sensor 182, is not as high within the oil tank 166, the electronic controller 28 causes the valve 160 to open or further open, allowing oil to flow from the oil tank 168 to the oil tank 166; as a result, the relationship between the respective oil levels within the oil tanks 166 and 168 is actively controlled. Additionally, in several exemplary embodiments, the electronic controller 28 also controls the valves 174 and/or 176, to facilitate the actively controlled relationship between the respective oil levels within the oil tanks 166 and 168. In several exemplary embodiments, the use of measurement data from each of the level sensors 182 and 184 increases the degree to which the respective oil levels within the oil tanks 166 and 168 are precisely controlled.

In an exemplary embodiment, during the operation of the system 40, the valve 176 is initially closed and the valve 174 is initially open, and all oil flowing out of the one or more three-phase separators 20, via the fluid line 164, at least initially flows into the oil tank 166 via the header 162 and the fluid line 170. If the oil level within the oil tank 166 becomes too high, the electronic controller 28 causes the valve 180 to open or further open, allowing oil to flow from the oil tank 166 to the oil tank 168; as a result, the relationship between the respective oil levels within the oil tanks 166 and 168 is actively controlled.

In an exemplary embodiment, during the operation of the system 40, the valve 174 is initially closed and the valve 176 is initially open, and all oil flowing out of the one or more three-phase separators 20, via the fluid line 164, at least initially flows into the oil tank 168 via the header 162 and the fluid line 172. If the oil level within the oil tank 168 becomes too high, the electronic controller 28 causes the valve 180 to open or further open, allowing oil to flow from the oil tank 168 to the oil tank 166; as a result, the relationship between the respective oil levels within the oil tanks 166 and 168 is actively controlled.

As noted above, the remainder of the operation of the system 40, as illustrated in FIG. 4 with the above-described modifications of the system 40 illustrated in FIG. 10, is substantially identical to the operation of the system 40 described above with reference to FIG. 4; therefore, the remainder of the operation will not be described in further detail.

In several exemplary embodiments, the system 40 may include one or more other fluid reservoirs, in addition to the fluid reservoirs 22 and 42; in several exemplary embodiments, the different relationships between the respective fluid levels in all of these fluid reservoirs may be actively controlled in accordance with the foregoing. In several exemplary embodiments, the system 40 may include one or more other oil tanks, in addition to the oil tanks 166 and 168; in several exemplary embodiments, the different relationships between the respective oil levels in all of these oil tanks may be actively controlled in accordance with the foregoing.

In several exemplary embodiments, referring back to FIG. 5, the fluid reservoir 22 of the system 52 may include two or more fluid reservoirs, each of which includes a fluid level sensor operably coupled thereto; in several exemplary embodiments, the relationship between the respective fluid levels in these two or more fluid reservoirs may be actively controlled in a manner substantially similar to either the above-described manner in which the relationship between the respective fluid levels within the fluid reservoirs 22 and 42 of FIG. 10 is actively controlled, or the above-described manner in which the relationship between the respective oil levels within the oil tanks 166 and 168 of FIG. 10 is actively controlled.

Figure 11:
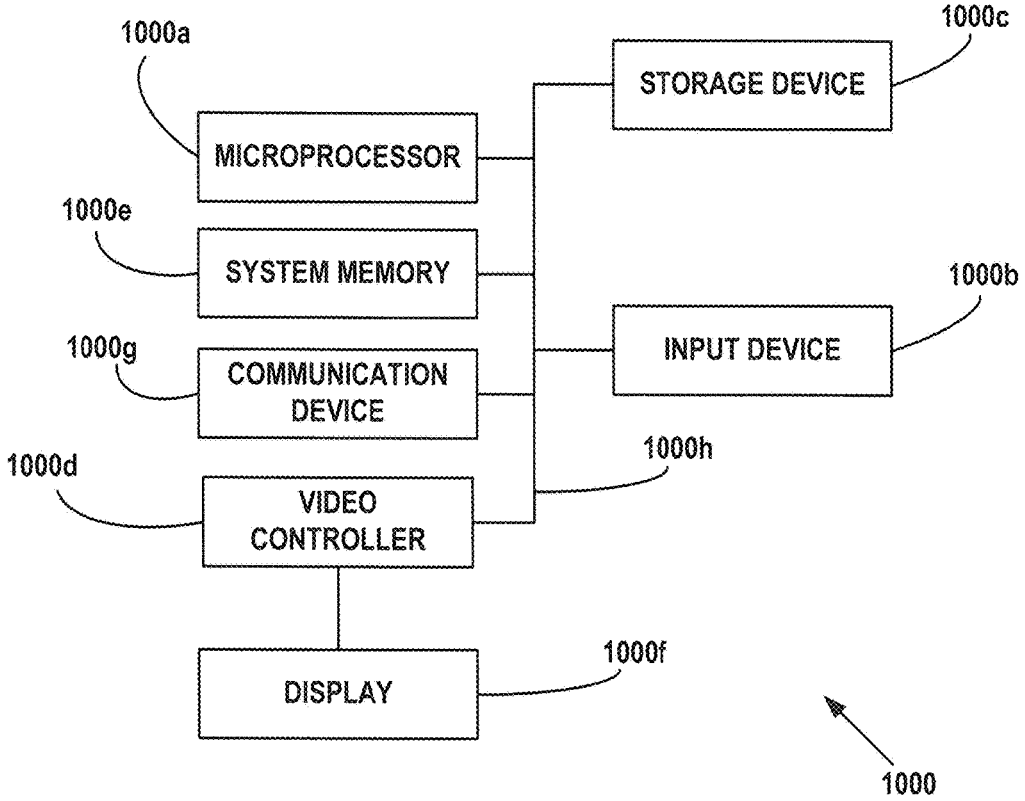
FIG. 11 is a diagrammatic illustration of a computing device for implementing one or more exemplary embodiments of the present disclosure, according to an exemplary embodiment.

In an exemplary embodiment, as illustrated in FIG. 11 with continuing reference to FIGS. 1-10, an illustrative computing device 1000 for implementing one or more embodiments of one or more of the above-described networks, elements, methods and/or steps, and/or any combination thereof, is depicted. The computing device 1000 includes a microprocessor 1000*a*, an input device 1000*b*, a storage device 1000*c*, a video controller 1000*d*, a system memory 1000*e*, a display 1000*f*, and a communication device 1000*g* all interconnected by one or more buses 1000*h*. In several exemplary embodiments, the storage device 1000*c* may include a floppy drive, hard drive, CD-ROM, optical drive, any other form of storage device and/or any combination thereof. In several exemplary embodiments, the storage device 1000*c* may include, and/or be capable of receiving, a floppy disk, CD-ROM, DVD-ROM, or any other form of computer-readable medium that may contain executable instructions. In several exemplary embodiments, the communication device 1000*g* may include a modem, network card, or any other device to enable the computing device to communicate with other computing devices. In several exemplary embodiments, any computing device represents a plurality of interconnected (whether by intranet or Internet) computer systems, including without limitation, personal computers, mainframes, PDAs, smartphones and cell phones.

In several exemplary embodiments, one or more of the components of the above-described exemplary embodiments include at least the computing device 1000 and/or components thereof, and/or one or more computing devices that are substantially similar to the computing device 1000 and/or components thereof. In several exemplary embodiments, one or more of the above-described components of the computing device 1000 include respective pluralities of same components.

In several exemplary embodiments, a computer system typically includes at least hardware capable of executing machine readable instructions, as well as the software for executing acts (typically machine-readable instructions) that produce a desired result. In several exemplary embodiments, a computer system may include hybrids of hardware and software, as well as computer sub-systems.

In several exemplary embodiments, hardware generally includes at least processor-capable platforms, such as client-machines (also known as personal computers or servers), and hand-held processing devices (such as smart phones, tablet computers, personal digital assistants (PDAs), or personal computing devices (PCDs), for example). In several exemplary embodiments, hardware may include any physical device that is capable of storing machine-readable instructions, such as memory or other data storage devices. In several exemplary embodiments, other forms of hardware include hardware sub-systems, including transfer devices such as modems, modem cards, ports, and port cards, for example.

In several exemplary embodiments, software includes any machine code stored in any memory medium, such as RAM or ROM, and machine code stored on other devices (such as floppy disks, flash memory, or a CD ROM, for example). In several exemplary embodiments, software may include source or object code. In several exemplary embodiments, software encompasses any set of instructions capable of being executed on a computing device such as, for example, on a client machine or server.

In several exemplary embodiments, combinations of software and hardware could also be used for providing enhanced functionality and performance for certain embodiments of the present disclosure. In an exemplary embodiment, software functions may be directly manufactured into a silicon chip. Accordingly, it should be understood that combinations of hardware and software are also included within the definition of a computer system and are thus envisioned by the present disclosure as possible equivalent structures and equivalent methods.

In several exemplary embodiments, computer readable mediums include, for example, passive data storage, such as a random access memory (RAM) as well as semi-permanent data storage such as a compact disk read only memory (CD-ROM). One or more exemplary embodiments of the present disclosure may be embodied in the RAM of a computer to transform a standard computer into a new specific computing machine. In several exemplary embodiments, data structures are defined organizations of data that may enable an embodiment of the present disclosure. In an exemplary embodiment, a data structure may provide an organization of data, or an organization of executable code.

In several exemplary embodiments, any networks and/or one or more portions thereof may be designed to work on any specific architecture. In an exemplary embodiment, one or more portions of any networks may be executed on a single computer, local area networks, client-server networks, wide area networks, internets, hand-held and other portable and wireless devices and networks.

In several exemplary embodiments, a database may be any standard or proprietary database software. In several exemplary embodiments, the database may have fields, records, data, and other database elements that may be associated through database specific software. In several exemplary embodiments, data may be mapped. In several exemplary embodiments, mapping is the process of associating one data entry with another data entry. In an exemplary embodiment, the data contained in the location of a character file can be mapped to a field in a second table. In several exemplary embodiments, the physical location of the database is not limiting, and the database may be distributed. In an exemplary embodiment, the database may exist remotely from the server, and run on a separate platform. In an exemplary embodiment, the database may be accessible across the Internet. In several exemplary embodiments, more than one database may be implemented.

In several exemplary embodiments, a plurality of instructions stored on a non-transitory computer readable medium may be executed by one or more processors to cause the one or more processors to carry out or implement in whole or in part the above-described operation of each of the above-described exemplary embodiments of the system 10, the system 40, the method 36, the system 52, the method 106, the embodiment of the vent gas analyzer and flow meter 82 illustrated in FIGS. 7 and 8, the method 146, the system 40 with the modification thereof illustrated in FIG. 10, and/or any combination thereof. In several exemplary embodiments, such a processor may include the microprocessor 1000*a*, one or more components of the electronic controller 28, the controller 136, the processor 138, and/or any combination thereof, and such a non-transitory computer readable medium may include the storage device 1000*c*, the system memory 1000*e*, one or more components of the electronic controller 28, one or more components of the controller 136 such as, for example, the computer readable medium 140, and/or may be distributed among one or more components of the system 10, 40, or 52. In several exemplary embodiments, such a processor may execute the plurality of instructions in connection with a virtual computer system. In several exemplary embodiments, such a plurality of instructions may communicate directly with the one or more processors, and/or may interact with one or more operating systems, middleware, firmware, other applications, and/or any combination thereof, to cause the one or more processors to execute the instructions.

In the foregoing description of certain embodiments, specific terminology has been resorted to for the sake of clarity. However, the disclosure is not intended to be limited to the specific terms so selected, and it is to be understood that each specific term includes other technical equivalents which operate in a similar manner to accomplish a similar technical purpose. Terms such as "left" and right", "front" and "rear", "above" and "below" and the like are used as words of convenience to provide reference points and are not to be construed as limiting terms.

In this specification, the word "comprising" is to be understood in its "open" sense, that is, in the sense of "including", and thus not limited to its "closed" sense, that is the sense of "consisting only of". A corresponding meaning is to be attributed to the corresponding words "comprise", "comprised" and "comprises" where they appear.

In addition, the foregoing describes only some embodiments of the invention(s), and alterations, modifications, additions and/or changes can be made thereto without departing from the scope and spirit of the disclosed embodiments, the embodiments being illustrative and not restrictive.

Furthermore, invention(s) have described in connection with what are presently considered to be the most practical and preferred embodiments, it is to be understood that the invention is not to be limited to the disclosed embodiments, but on the contrary, is intended to cover various modifications and equivalent arrangements included within the spirit and scope of the invention(s). Also, the various embodiments described above may be implemented in conjunction with other embodiments, e.g., aspects of one embodiment may be combined with aspects of another embodiment to realize yet other embodiments. Further, each independent feature or component of any given assembly may constitute an additional embodiment.

What is claimed is:

1. A method of actively controlling one or more operating parameters associated with a wellhead in fluid communication with a wellbore and a first valve in fluid communication with the wellhead during frac flow-back operation, the method comprising:

measuring, using one or more sensors, one or more physical properties associated with wellbore fluid flowing out of the wellbore to the wellhead, the one or more sensors generating measurement data;

transmitting measurement data from the one or more sensors to an electronic controller, the measurement data being associated with the respective measurements of the one or more physical properties;

controlling, using the electronic controller, the first valve based on at least a first portion of the measurement data;

wherein controlling the first valve actively controls at least one of the one or more operating parameters associated with the wellhead; and wherein actively controlling the one or more operating parameters associated with the wellhead during frac flow-back operation facilitates the maintenance of the integrity of the wellbore and the enhancement of hydrocarbon production out of the wellbore.

2. The method of claim 1, wherein measuring one or more physical properties associated with the wellbore fluid flow out of the wellhead comprises measuring one or more physical properties associated with frac flow-back.

3. The method of claim 1, wherein actively controlling the one or more operating parameters comprises:

controlling a velocity of the wellbore fluid, and a pressure of the wellbore;

wherein the control of the first valve actively controls the pressure of the wellbore; and wherein the method further comprises controlling, using the electronic controller, a second valve based on at least:

the first portion of the measurement data, and/or a second portion of the measurement data;

wherein controlling the second valve actively controls the velocity of the wellbore fluid.

4. The method of claim 3, wherein controlling the first valve and controlling the second valve maintain the integrity of the wellbore and enhance hydrocarbon production out of the wellbore.

5. The method of claim 3, further comprising reading, using the electronic controller, the measurement data received from the one or more sensors; and wherein controlling, using the electronic controller, the first valve based on at least the first portion of the measurement data comprises:

transmitting a first control output from the electronic controller to the first valve comprising a first actuated choke having an open/closed position, the first control output being based on at least the first portion of the measurement data; and adjusting the open/closed position of the first actuated choke based on the first control output.

6. The method of claim 5, wherein the adjustment of the open/closed position of the first actuated choke actively controls the pressure of the wellbore;

wherein the second valve comprises a second actuated choke, which is in communication with the electronic controller and has an open/closed position;

wherein controlling, using the electronic controller, the second valve based on at least the first portion of the measurement and/or the second portion of the measurement data comprises:

transmitting a second control output from the electronic controller to the second actuated choke, the second control output being based on at least the first portion of the measurement data and/or the second portion of the measurement data; and adjusting the open/closed position of the second actuated choke based on the second control output to actively control the velocity of the wellbore fluid.

7. The method of claim 1, wherein measuring, using one or more sensors, comprises measuring using at least two of the following sensors:

a first pressure sensor operably coupled to a first fluid line extending between the wellhead and the first actuated choke;

a second pressure sensor operably coupled to a second fluid line extending between the first actuated choke and a first fixed choke;

a third pressure sensor operably coupled to a third fluid line extending between the first fixed choke and a second fixed choke;

a fourth pressure sensor operably coupled to a fourth fluid line extending between the second fixed choke and the second actuated choke;

a fifth pressure sensor operably coupled to a fifth fluid line extending between the second actuated choke and a separator;

a sixth pressure sensor operably coupled to a sixth fluid line extending between the separator and a fluid reservoir;

a level sensor operably coupled to either the separator or the fluid reservoir;

a temperature sensor operably coupled to the first fluid line extending between the wellhead and the first actuated choke.

8. The method of claim 1, wherein measuring, using one or more sensors, one or more physical properties comprises:

measuring a first fluid level within a separator through which the wellbore fluid flows after flowing out of the wellhead; and/or measuring a second fluid level within a fluid reservoir into which at least a portion of the wellbore fluid flows after flowing out of the wellhead.

9. The method of claim 1, wherein actively controlling one or more operating parameters comprises controlling a velocity of the wellbore fluid flowing out of the wellhead;

wherein the one or more physical properties comprise a fluid level within a fluid reservoir into which at least a portion of the wellbore fluid is adapted to flow; and wherein the first portion of the measurement data comprises measurement data associated with the measurement of the fluid level within the fluid reservoir.

10. The method of claim 1, wherein controlling the first valve comprises opening and closing the first valve;

wherein an electric actuator is operably coupled to the first valve; and wherein controlling the first valve based on at least a first portion of the measurement data comprises:

reading, using the electronic controller, the measurement data received from the one or more sensors;

transmitting a control output from the electronic controller to the electric actuator, the control output being based on at least the measurement data received from the one or more sensors and read by the electronic controller; and adjusting, using the electric actuator, the open/closed position of the valve based on the control output.

11. The method of claim 10, wherein controlling the first valve comprises controlling a choke valve to which the electric actuator is operably coupled; and wherein the choke valve and the electric actuator operably coupled thereto are mounted on, and/or are part of, a choke manifold skid.

12. The method of claim 10, wherein transmitting a control output comprises transmitting one or more electrical control signals.

13. The method of claim 1, wherein controlling the first valve by the electronic controller comprises:

using at least one of a continuous proportional-integral-derivative (PID) algorithm having a first measured process variable; and a discrete PID algorithm having a second measured process variable; and wherein each of the first and second measured process variables is either:

a rate of change of a fluid level within the fluid reservoir into which at least a portion of the wellbore fluid flows; or a pressure of the wellbore.

14. The method of claim 1, wherein measuring one or more physical properties comprises measuring a fluid level within a fluid reservoir into which at least a portion of the wellbore fluid flows after flowing out of the wellhead;

wherein the one or more sensors comprise a level sensor that measures the fluid level within the fluid reservoir; and wherein the at least a portion of the wellbore fluid flows through one or more three-phase separators after flowing through the valve and before flowing into the fluid reservoir.

15. A system adapted to actively control one or more operating parameters associated with a wellhead in fluid communication with a wellbore and a first valve in fluid communication with the wellhead during frac flow-back operation, the system comprising:

one or more sensors, each of which is adapted to measure a physical property associated with a wellbore fluid flowing out of a wellbore extending in a subterranean formation via the wellhead and generate measurement data;

an electronic controller adapted to receive from the one or more sensors measurement data associated with the respective measurements of the one or more physical properties; and a first valve through which the wellbore fluid is adapted to flow, wherein the first valve is adapted to be in fluid communication with the wellhead, and wherein the first valve is adapted to be in communication with the electronic controller so that the electronic controller is adapted to automatically control the first valve, based on at least a first portion of the measurement data, to actively control at least one of the one or more operating parameters; and wherein the active control of the at least one of the one or more operating parameters during frac flow-back operation is adapted to facilitate the maintenance of the integrity of the wellbore and enhancement of hydrocarbon production out of the wellbore.

16. The system of claim 15, wherein the one or more operating parameters comprise: a velocity of the wellbore fluid, and a pressure of the wellbore;

wherein the control of the first valve actively controls the pressure of the wellbore; and wherein the system further comprises a second valve through which the wellbore fluid is adapted to flow;

wherein the second valve is adapted to be in communication with the electronic controller so that the electronic controller is adapted to automatically control the second valve based on at least:

the first portion of the measurement data, and/or a second portion of the measurement data; and wherein the control of the second valve actively controls the velocity of the wellbore fluid.

17. The system of claim 16, wherein the first valve comprises a first actuated choke, which has an open/closed position;

wherein the electronic controller is adapted to read the measurement data received from the one or more sensors;

wherein the electronic controller is adapted to transmit a first control output to the first actuated choke, the first control output being based on at least the first portion of the measurement data; and wherein the first actuated choke is adapted to adjust its open/closed position based on the first control output.

18. The system of claim 17, wherein the first actuated choke is adapted to adjust its open/closed position, based on the first control output, to actively control the pressure of the wellbore;

wherein the second valve is a second actuated choke, which has an open/closed position;

wherein the electronic controller is adapted to transmit a second control output to the second actuated choke, the second control output being based on at least the first portion of the measurement data and/or the second portion of the measurement data;

wherein the second actuated choke is adapted to adjust its open/closed position, based on the second control output, to actively control the velocity of the wellbore fluid.

19. The system of claim 16, wherein the first and second valves comprise first and second actuated chokes, respectively; and wherein the system further comprises:

a first fixed choke adapted to be fluidically positioned between the first and second actuated chokes; and a second fixed choke adapted to be fluidically positioned between the first fixed choke and the second electrical-actuated choke.

20. The system of claim 19, wherein the one or more sensors comprise two or more of the following sensors:

a first pressure sensor adapted to measure pressure at a location fluidically positioned between the wellbore and the first actuated choke;

a second pressure sensor adapted to measure pressure at a location fluidically positioned between the first actuated choke and the first fixed choke;

a third pressure sensor adapted to measure pressure at a location fluidically positioned between the first and second fixed chokes; and a fourth pressure sensor adapted to measure pressure at a location fluidically positioned between the second fixed choke and the second actuated choke;

a fifth pressure sensor adapted to measure pressure at a location fluidically positioned between the second actuated choke and a separator;

a sixth pressure sensor adapted to measure pressure at a location fluidically positioned between the separator and a fluid reservoir;

a level sensor adapted to measure a fluid level in either the separator or the fluid reservoir; and a temperature sensor adapted to measure temperature at a location fluidically positioned between the wellbore and the first actuated choke.

21. The system of claim 15, further comprising an electric actuator operably coupled to the first valve, the first valve having an open/closed position; and wherein the electronic controller is adapted to read the measurement data received from the one or more sensors;

wherein the electronic controller is adapted to transmit a control output to the electric actuator, the control output being based on at least the measurement data received from the one or more sensors and read by the electronic controller; and wherein the first valve is adapted to adjust its open/closed position based on the control output.

22. The system of claim 21, wherein the first valve comprises a choke valve to which the electric actuator is operably coupled; and wherein the choke valve and the electric actuator operably coupled thereto are mounted on, and/or are part of, a choke manifold skid.

23. The system of claim 15, wherein the electronic controller is adapted to control the first valve using:

a continuous proportional-integral-derivative (PID) algorithm having a first measured process variable; and/or a discrete PID algorithm having a second measured process variable; and wherein each of the first and second measured process variables is either:

a rate of change of a fluid level within a fluid reservoir into which at least a portion of the wellbore fluid is adapted to flow; or a pressure of the wellbore.

* * * * *